US011060337B2

(12) United States Patent
Sobolewski et al.

(10) Patent No.: US 11,060,337 B2
(45) Date of Patent: Jul. 13, 2021

(54) PIVOT DRIVE AND PIECE OF FURNITURE

(71) Applicant: Hettich-ONI GmbH & Co. KG, Vlotho (DE)

(72) Inventors: Uwe Sobolewski, Buende (DE); Michael Tasche, Bielefeld (DE); Gerhard Goetz, Buende (DE)

(73) Assignee: Hettich-ONI GmbH & Co. KG, Vlotho (DE)

( * ) Notice: Subject to any disclaimer, the term of this patent is extended or adjusted under 35 U.S.C. 154(b) by 78 days.

(21) Appl. No.: 16/605,563

(22) PCT Filed: Apr. 12, 2018

(86) PCT No.: PCT/EP2018/059408
§ 371 (c)(1),
(2) Date: Oct. 16, 2019

(87) PCT Pub. No.: WO2018/192835
PCT Pub. Date: Oct. 25, 2018

(65) Prior Publication Data

US 2020/0123827 A1 Apr. 23, 2020

(30) Foreign Application Priority Data

Apr. 18, 2017 (DE) ..... 10 2017 108 197.6

(51) Int. Cl.
*E05F 1/10* (2006.01)
*E05F 3/00* (2006.01)

(52) U.S. Cl.
CPC ..... *E05F 1/10* (2013.01); *E05F 3/00* (2013.01); *E05Y 2900/20* (2013.01)

(58) Field of Classification Search
CPC ..... E05F 1/10; E05F 3/00; E05F 3/06; E05F 5/02; E05F 1/1041; E05F 1/1058;
(Continued)

(56) References Cited

U.S. PATENT DOCUMENTS 5,904,411 A * 5/1999 Hayakawa ..... E05D 15/582 312/319.2
7,562,757 B2 * 7/2009 Dubach ..... E05F 5/00 192/215

(Continued)

FOREIGN PATENT DOCUMENTS

AT 517591 * 3/2017
AT 519935 * 11/2018

(Continued)

OTHER PUBLICATIONS

International Search Report of PCT/EP2018/059408 dated Jun. 25, 2018.

(Continued)

*Primary Examiner* — Janet M Wilkens
(74) *Attorney, Agent, or Firm* — Collard & Roe, P.C.

(57) ABSTRACT

A pivot drive for a movable piece of furniture has an actuating arm which is mounted so that it can be pivoted about an axis of rotation, a spring assembly having at least one spring guided linearly in one working direction and a pressure-exerting component connected to the spring assembly and movable along a control curve, and a housing on or in which the pivot drive is mounted and a piece of furniture.

19 Claims, 28 Drawing Sheets

(58) Field of Classification Search

CPC ... E05Y 2900/20; A47B 96/04; A47B 96/205; A47B 95/00; A47B 2096/207; E05D 15/40; E05D 15/00; E05D 7/00; E05D 11/087; E05D 11/00; E05D 3/14; E06B 3/5045

USPC ..... 312/322, 323, 319.1–319.4

See application file for complete search history.

(56) References Cited

U.S. PATENT DOCUMENTS

| | | | | |
|---|---|---|---|---|
| 7,798,541 | B2 | 9/2010 | Hirtsiefer | |
| 10,590,688 | B2 | 3/2020 | Salice | |
| 10,722,031 | B2 * | 7/2020 | Sobolewski | A47B 96/04 |
| 10,820,701 | B2 * | 11/2020 | Sobolewski | A47B 96/205 |
| 10,876,336 | B2 * | 12/2020 | Kruedener | E05D 7/125 |
| 2012/0326585 | A1 * | 12/2012 | Dorsey | A47B 88/467 312/319.1 |
| 2015/0351539 | A1 * | 12/2015 | Baldreich | A47B 97/00 312/319.2 |
| 2017/0204645 | A1 | 7/2017 | Lubetz et al. | |
| 2020/0008579 | A1 * | 1/2020 | Sobolewski | E05D 3/06 |
| 2020/0040634 | A1 * | 2/2020 | Giovannetti | E05F 1/1058 |
| 2020/0340278 | A1 * | 10/2020 | Giovannetti | E05F 1/1058 |
| 2020/0362612 | A1 * | 11/2020 | Nordieker | E05F 1/1058 |
| 2021/0010311 | A1 * | 1/2021 | Nordieker | E05F 1/1058 |

FOREIGN PATENT DOCUMENTS

| | | | |
|---|---|---|---|
| DE | 524463 | * | 5/1931 |
| DE | 10203269 | * | 8/2003 |
| DE | 202010015091 | U1 | 2/2012 |
| DE | 102016125436 | * | 6/2018 |
| DE | 102017104169 | * | 8/2018 |
| DE | 102017104170 | * | 8/2018 |
| DE | 102017104171 | * | 8/2018 |
| DE | 102017104184 | * | 8/2018 |
| DE | 102018100204 | * | 7/2019 |
| DE | 102018100206 | * | 7/2019 |
| DE | 202018102089 | * | 7/2019 |
| DE | 102018120661 | * | 2/2020 |
| EP | 1148200 | A2 | 10/2001 |
| EP | 1154109 | * | 11/2001 |
| EP | 2251514 | A1 | 11/2010 |
| WO | 2004104339 | A1 | 12/2004 |
| WO | 2016077851 | A1 | 5/2016 |
| WO | 2016/131770 | A1 | 8/2016 |

OTHER PUBLICATIONS

German Office Action dated Mar. 21, 2018 (with English translation of relevant parts).

European Office Action dated Sep. 15, 2020 issued in the corresponding European Application Serial No. EP 18 719 778.5 (with English translation of relevant parts).

* cited by examiner

PIVOT DRIVE AND PIECE OF FURNITURE

CROSS REFERENCE TO RELATED APPLICATIONS

This application is the National Stage of PCT/EP2018/059408 filed on Apr. 12, 2018, which claims priority under 35 U.S.C. § 119 of German Application No. 10 2017 108 197.6 filed on Apr. 18, 2017, the disclosures of which are incorporated by reference. The international application under PCT article 21(2) was not published in English.

BACKGROUND OF THE INVENTION

The present invention relates to a pivot drive for a movable piece of furniture having an actuating arm which is mounted so that it can be pivoted about an axis of rotation, a spring assembly having at least one spring guided linearly in one working direction and a pressure-exerting component connected to the spring assembly and movable along a control curve, and a housing on or in which the pivot drive is mounted and a piece of furniture.

DE 20 2010 015 091 U1 discloses a furniture fitting for driving a flap in which a power drive with springs acts on a power deflection lever to pretension a joint drive in the opening or closing direction. To adjust the force, a coupling element can be adjusted on the deflection lever. The disadvantage here is that different spring forces and a different spring force progression depending on the opening position of the flap are required for flaps of different widths and weights. The adjustment possibilities for this furniture fitting are insufficient.

WO 2016/077851 discloses an actuating drive for moving a furniture part in which a spring device acts on a rotating actuating arm via a transmission mechanism. A pressure-exerting component loaded by a spring device can be moved along an actuating contour, which can be adjusted relative to the actuating part to adjust the spring force. Although such an actuating drive allows a compact design, the adjustment options are limited because the actuating contour is arranged between the pressure-exerting component and the actuating arm. This leads to unfavorable lever ratios and to problems with a necessary contour change of the actuating contour.

SUMMARY OF THE INVENTION

It is therefore the object of the present invention to create a pivot drive and a piece of furniture by means of which a force acting on an actuating arm can be flexibly adjusted for different positions of the actuating arm.

A piece of furniture is understood to be a furnishing item for a room, wherein the furnishing items can also be household appliances such as a refrigerator.

This object is solved with a pivot drive with the features of claim 1.

The pivot drive according to the invention comprises a rotatable actuating arm which is non-rotatably connected to a spring assembly and can be pivoted therewith about an axis of rotation, wherein the spring assembly acts on a pressure-exerting component which can be moved along a control curve which can be adjusted relative to the axis of rotation of the actuating arm to set the spring force of the spring assembly. The actuating arm is connected to the movable part of the furniture via a multi-joint connection, wherein the force exerted by the spring assembly on the control curve can be adjusted additionally or alternatively. This means that the control curve and the axis of rotation for the actuating arm and the spring assembly can be arranged on opposite sides of the spring assembly so that the relative adjustment options on the control curve are flexible and the travel of the pressure-exerting component along the control curve is not structurally limited. This results in favorable lever ratios and a simple design, as the actuating arm is connected to the spring assembly in a rotationally fixed manner and the control curve is adjusted relative to the fixed axis of rotation to adjust the spring force.

Preferably, the control curve can be adjusted in an infinitely variable manner via actuating means. This enables precise adjustment of the spring forces acting on the actuating arm. The pivot drive can comprise a housing on or in which the control curve is held adjustable, e.g. by guide means, thread adjustments, eccentric adjustment, screw adjustments or other mechanical means. The control curve can be mounted so that it can be rotated and/or moved relative to the axis of rotation of the actuating arm in order to be able to make a flexible adjustment. If the control curve is adjustable in the direction of action of the spring assembly, the magnitude of the force applied by the spring assembly can be changed. Alternatively, this is also possible by changing the pretension of the spring assembly. If, on the other hand, the inclination of the control curve is changed, the force acting in a certain opening position of the actuating arm is adjusted, which is particularly advantageous in the case of flaps of different weight, as the center of gravity of these is shifted outwards from a furniture body when opening, and different spring forces are therefore required to compensate for the weight of the flap, depending on the opening position.

In a further embodiment, the spring assembly pretensions the actuating arm in the closing direction in a closing area, and in an opening area disposed adjacent to the closing area, the spring assembly pretensions the actuating arm in the opening direction. This causes a dead center to be passed through when the actuating arm is opened, and the direction of force on the actuating arm changes depending on the position of the actuating arm. In this arrangement, the spring assembly pivots in both directions of rotation during the opening movement.

In another embodiment, the spring assembly pretensions the actuating arm in a closing area in the closing direction, and in an opening area disposed adjacent to the closing area, the spring assembly pretensions the actuating arm in the opening direction. The change of the operating direction of the spring is achieved by the shape of the control curve. At the beginning of an opening movement of the actuating arm, a section of the control curve is traversed in which the spring assembly is tensioned and in the further course of the opening movement, the spring assembly is relaxed. In this arrangement, the spring assembly only pivots in one direction of rotation during the opening movement.

The actuating arm can be connected to a flap or door via a multi-joint connection. The pivot drive is preferably designed as a flap fitting to pivot a flap about a horizontal axis. But other applications are also possible. The flap can thus perform the movement of a flap, lid or bar compartment. The multi-joint connection can be designed as a four-joint connection with two parallel levers or as a seven-joint connection, but other multi-joint connections can also be provided on the pivot drive.

In order to also transmit high forces to the actuating arm via the spring assembly, the control curve preferably has a metal guideway. The pressure-exerting component may also have a roller with at least one metal surface and preferably made entirely of metal so that high forces can be transmitted between the pressure-exerting component and the guideway.

For a flat design of the spring assembly, it can comprise several helical springs arranged side by side, which are guided linearly in the direction of action of the spring assembly. Instead of a coil spring, disc springs or leaf springs or other compact springs can also be used.

Preferably, the control curve is immovable relative to the housing during an opening and/or closing movement of the movable furniture part, so that a furniture body, the control curve and the housing are stationary while the movable furniture part and the spring assembly are moving. The axis of rotation around which the spring assembly with the actuating arm rotates can be fixed in the housing so that the spring assembly with the actuating arm pivots around this axis of rotation.

In one embodiment of the multi-joint connection, a lever has two axes of rotation for moving the movable furniture part and a further joint or curve guide for indirect coupling with the actuating arm. For effective force transmission, a pressure-exerting component can be arranged on the actuating arm which interacts with the curve guide of the lever.

The total pivot angle of the spring assembly about the axis of rotation can be greater than 10° from the closed position to the fully open position of the movable part of the furniture, for example between 10° and 60°.

The pivot drive may also include one or more dampers which brake the actuating arm before reaching the closing position and/or a maximum opening position. Such dampers can be used as linear dampers, rotational dampers, within a multi-joint connection or on the spring assembly.

The pivot drive according to the invention is preferably used for furniture, in particular to pivot a flap. The pivot drive is preferably arranged in a side wall of a furniture body so that the internal useful volume of the furniture body is not reduced by the pivot drive. As an option, the pivot drive can also be fixed to the inside of a furniture body, thereby reducing the usable internal volume. If the pivot drive is provided in a side wall, the side wall may have a recess to accommodate a housing of the pivot drive. The housing of the pivot drive then has an opening facing the front side which, when a flap is opened, allows one or more articulated arms to be moved out of the side wall or housing of the pivot drive.

The side wall preferably has a plate-shaped core which has a first end face and further end faces, wherein a recess is arranged in the core which extends at least along a section of the first end face of the side wall and serves to receive a flap fitting which guides a movable furniture part. The plate-shaped core of the side wall is preferably arranged between two laterally applied cover layers. The core can optionally have two core halves which lie on top of each other with their side faces opposite the respective cover layers and have recesses complementary to the recess. With such a side wall, the pivot drive is arranged on one side wall of the piece of furniture.

BRIEF DESCRIPTION OF THE DRAWING FIGURES

The invention is explained in more detail below using several examples with reference to the attached drawings, wherein.

DETAILED DESCRIPTION OF THE INVENTION

Figure 1:
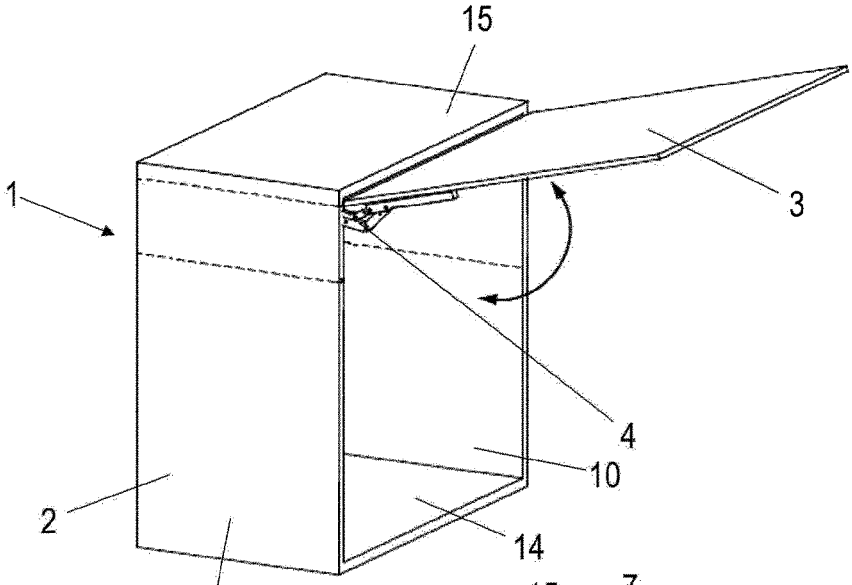
FIGS. 1 to 3 show several views of furniture with different flap fittings.

A piece of furniture 1 comprises a cabinet-shaped furniture body 2, having side walls 10, an upper panel 15 and a base 14, on which a flap 3 is pivotably mounted. A flap fitting 4 is provided for this purpose, by means of which flap 3 can be pivoted upwards, as shown schematically by the arrow. The flap fitting 4 is preloaded via a pivot drive not shown here, wherein the spring force is dependent on the opening position of flap 3.

Figure 2:
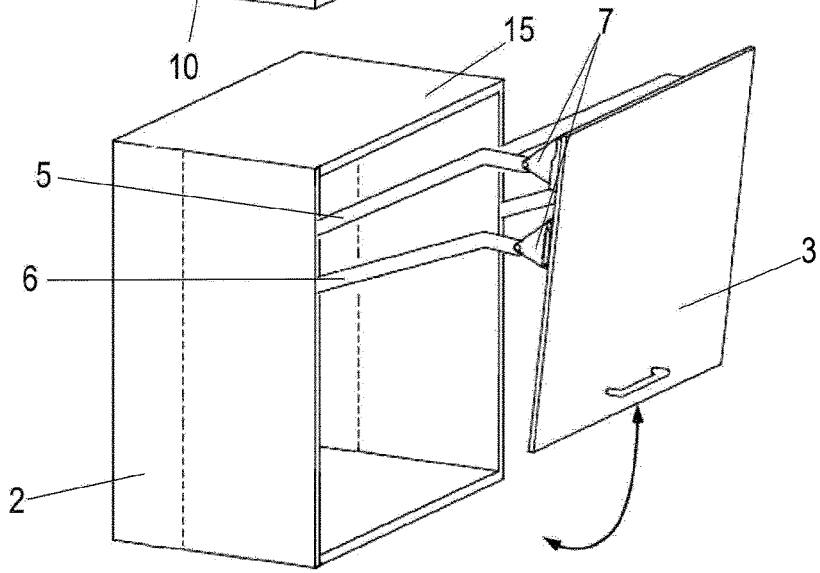
Figure 3:
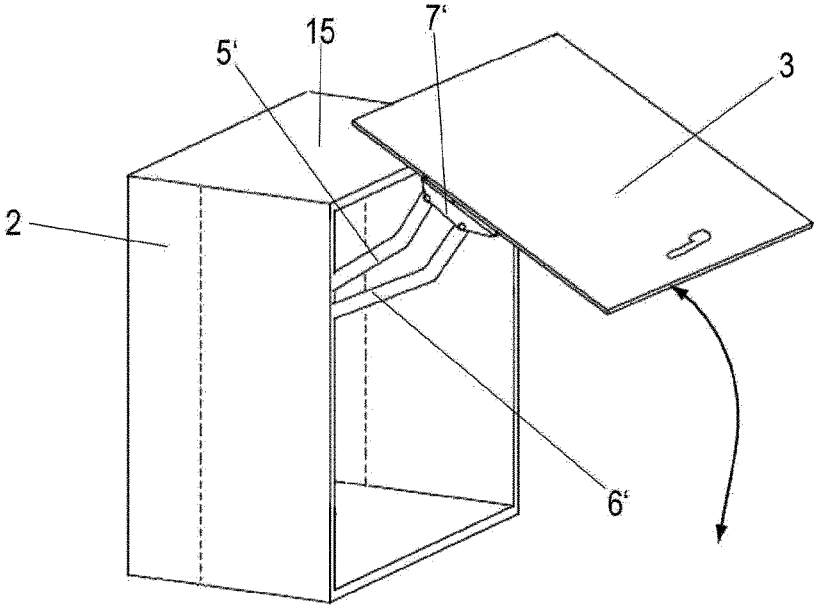

In FIG. 1, the flap fitting 4 is designed, for example, as a multi-joint connection, in particular as a seven-joint connection. It is also possible to design the flap fitting as a four-joint connection, as shown in FIGS. 2 and 3. A flap 3 is pivotably mounted on the furniture body 2 and can be moved by two parallel levers 5 and 6, which are held by a connection 7 or 7' on the levers 5 and 6. In FIG. 2 the flap 3 is essentially pivoted forward and upwards, while in FIG. 3 levers 5' and 6' are provided with a modified connection 7', by means of which the flap 3 can be pivoted along another curved path at least partially over the upper panel 15.

The flap fittings 4 according to FIGS. 1 to 3 can be fixed either on the inside of the side walls 10 or also in the side walls 10.

In order to provide a fitting in a side wall 10, a corresponding assembly procedure is described with reference to FIGS. 4A to 4H. A side wall 10 comprises an inner core 11, for example made of an MDF or HDF or lightweight panel, in which a recess 12 is introduced, for example by milling. The core 11 is covered on opposite sides by cover layers 13, which also cover the recess 12 so that a pocket-shaped receptacle is formed, which is only open at one front end face.

Figure 4A:
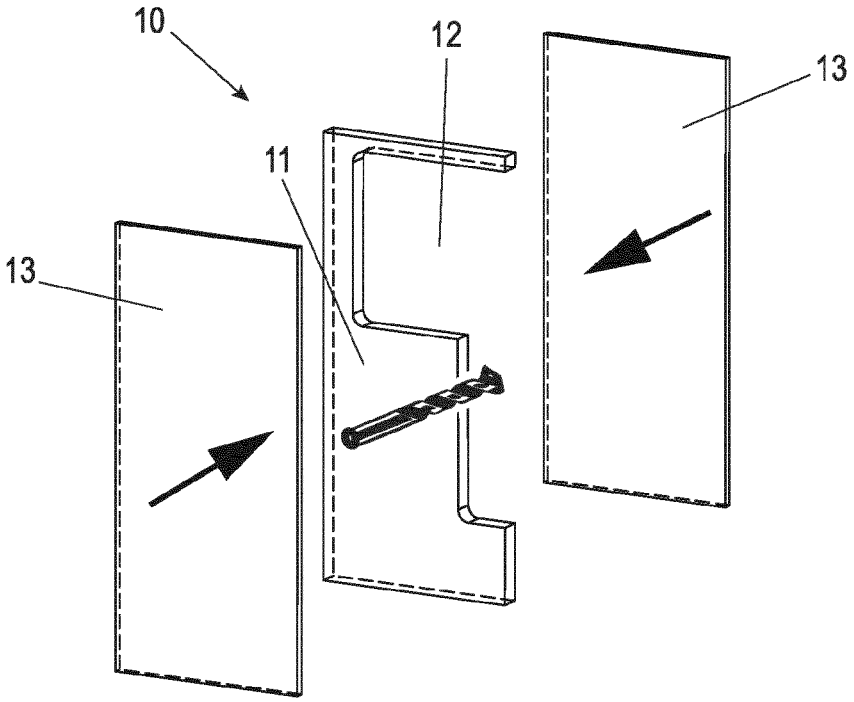
FIGS. 4A to 4H show several views of the assembly of a piece of furniture with the arrangement of a pivot drive in a side wall of the furniture.
Figure 4B:
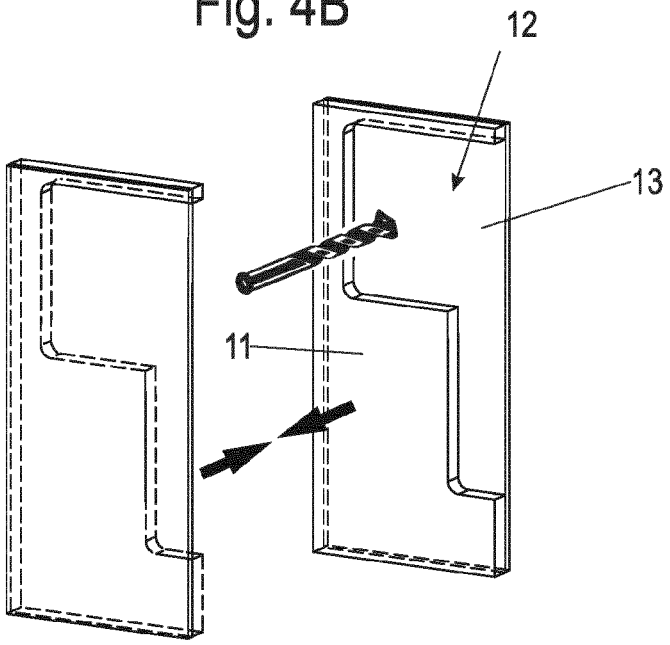
Figure 4C:
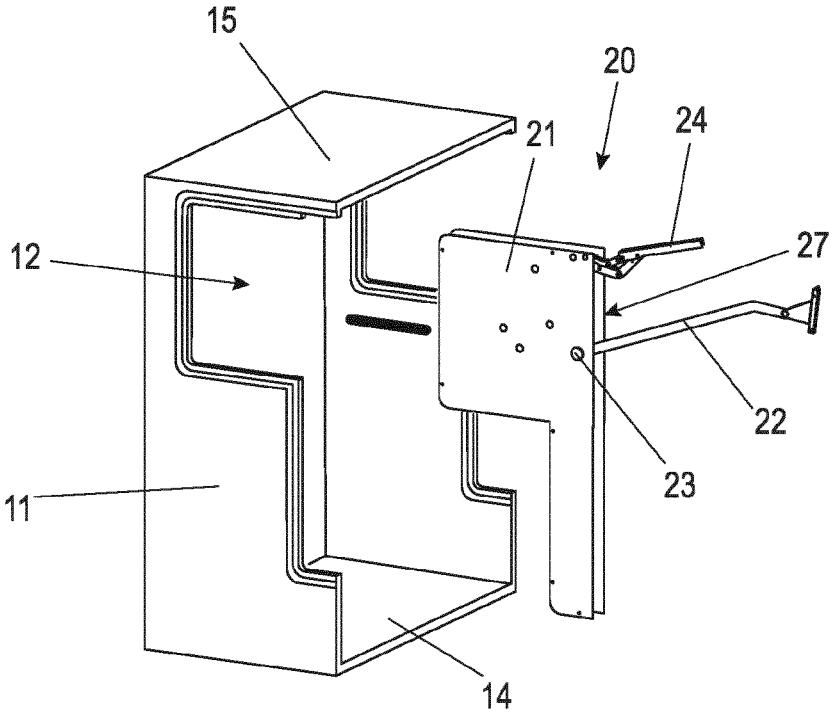

As shown in FIG. 4C, a fitting 20 with a housing 21 can be inserted into recess 12. The housing 21 has a width which corresponds to the width of the core 11 and can, for example, be between 12 mm and 22 mm, in particular between 12 mm and 17 mm. Housing 21 can also be narrower than the width of the core if housing 21 is inserted into the side in a different way. Housing 21 comprises two plates spaced apart from each other, between which levers of a multi-joint connection are provided, the axes of rotation of which are at least partially fixed to the housing 21. In the embodiment example shown, the lower arm 22 is rotatably mounted on an axis of rotation 23 of the housing 21. Furthermore, an upper arm 24 is arranged at a distance from the lower arm 22, which is provided by a hollow chamber of the housing 21 arranged in a receptacle 27.

Figure 4D:
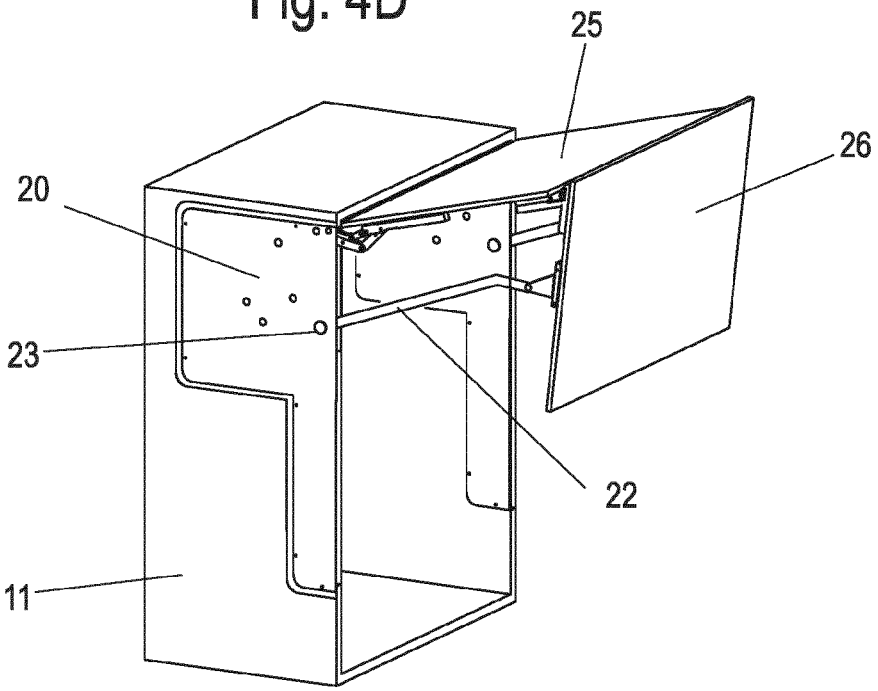

FIG. 4D shows the side walls without cover layers 13, and it can be seen that the fitting 20 with the housing is essentially positively inserted into the recess 12 of core 11. On the fitting 20, the arms 22 and 24 have flap parts 25 and 26 mounted on the arms, wherein an upper flap part 25 is held on the arm 24 and a lower flap part 26 is held on the lower arm 22, and the two flap parts 25 and 26 are connected to each other via a hinge connection, wherein the flap formed from the flap parts 25 and 26 folds open during opening.

Figure 4E:
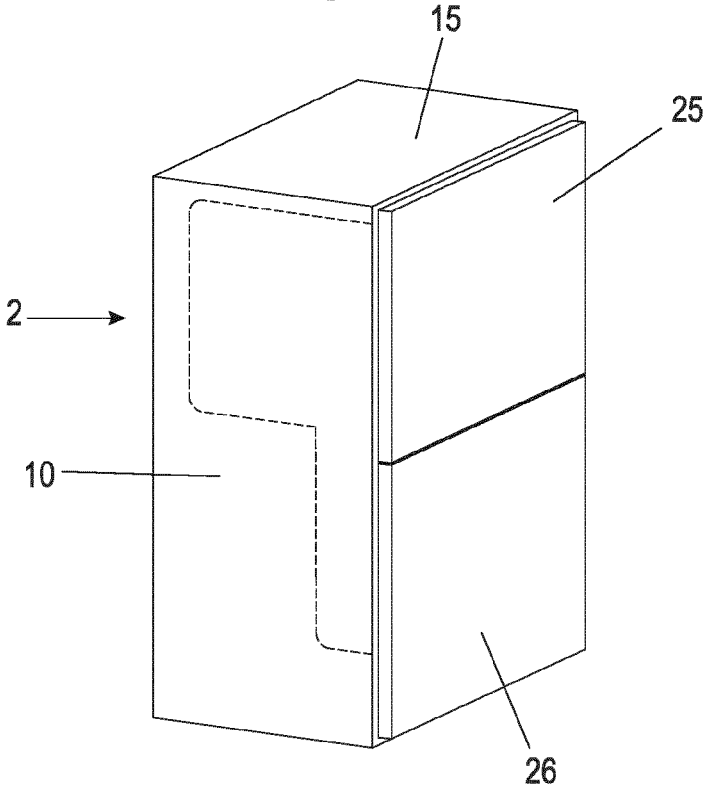
Figure 4F:
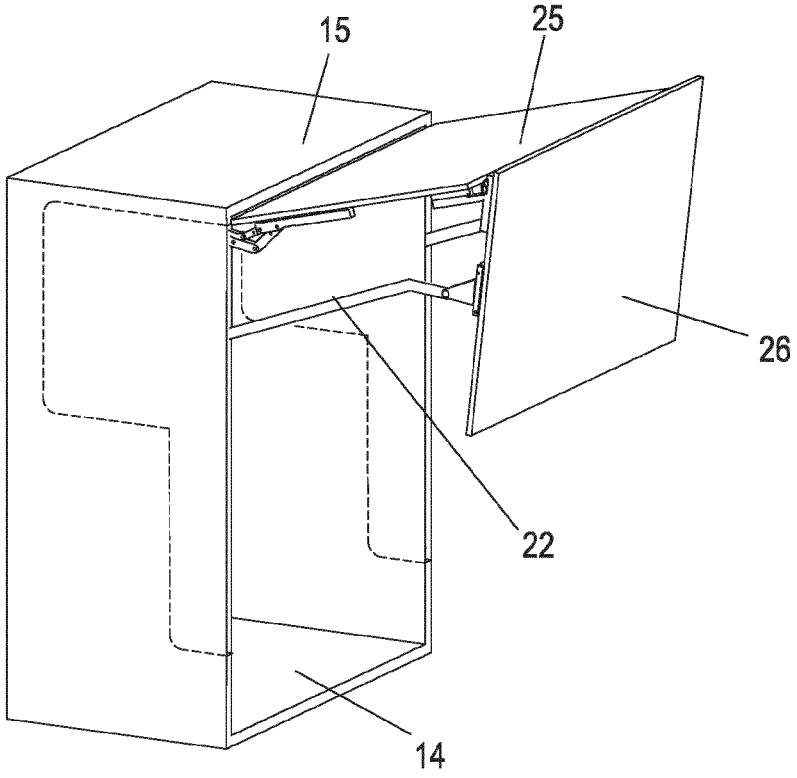

FIGS. 4E and 4F show two positions of furniture 1, wherein the side walls 10 are closed by the cover layers 13 so that the housing 21 of the fitting 20 is no longer visible. When the flap consisting of the flap parts 25 and 26 is opened, the arms 22 and 24 protrude forward out of the housing 21 of the fitting.

Figure 4H:
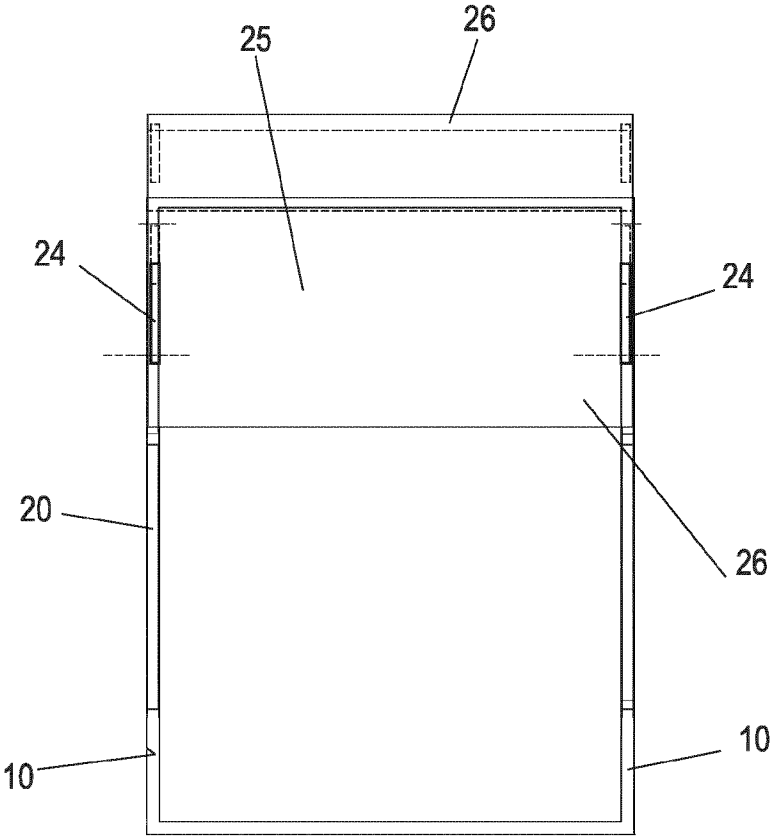
Figure 4G:
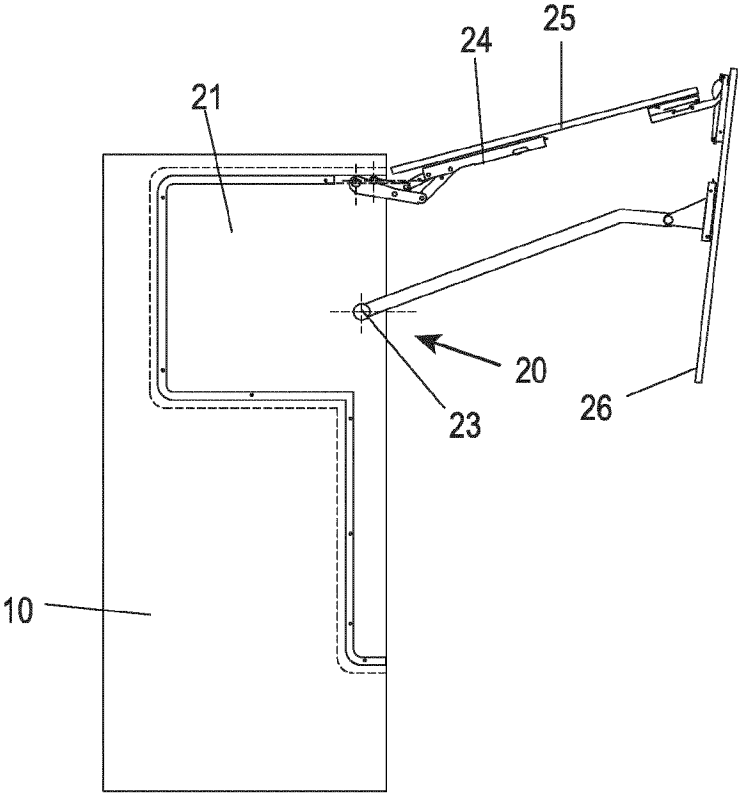

In FIGS. 4G and 4H, the furniture with fitting 20 is shown in one opening position, and it can be seen that fitting 20 with housing 21 is accommodated in side wall 10.

Figure 5:
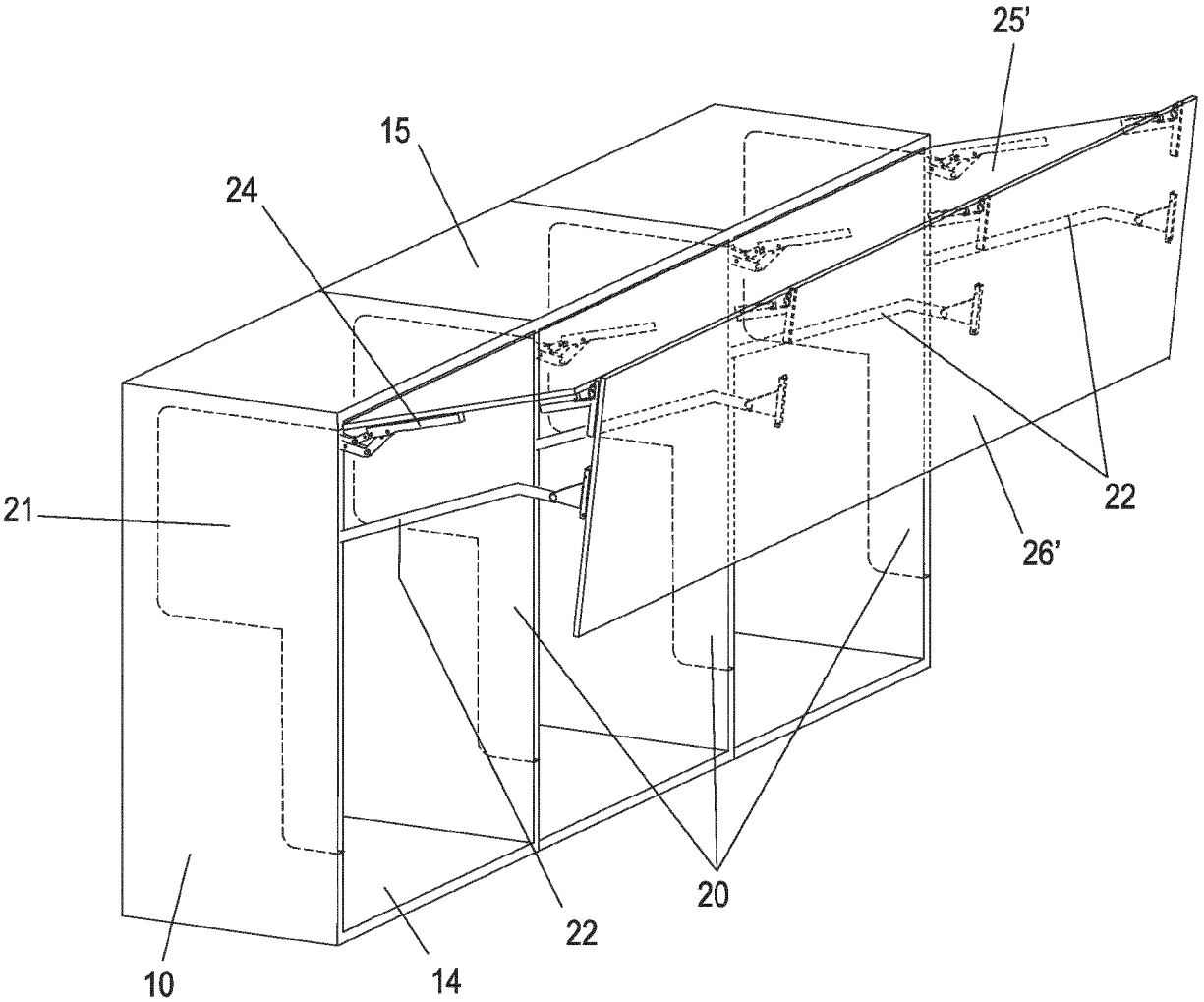
FIG. 5 shows a perspective view of a modified piece of furniture with a pivot drive in the side walls.

FIG. 5 shows a modified piece of furniture in which one furniture body has several adjacent interior spaces and one or more central partition walls are provided between the two outer side walls. A fitting 20 is also provided on each central partition wall so that a flap with flap parts 25' and 26' is considerably wider than in the previous embodiment example. The flap parts 25' and 26' are held to the furniture body by several fittings 20. The number of partition walls can be freely selected depending on the width of the furniture.

Figure 6A:
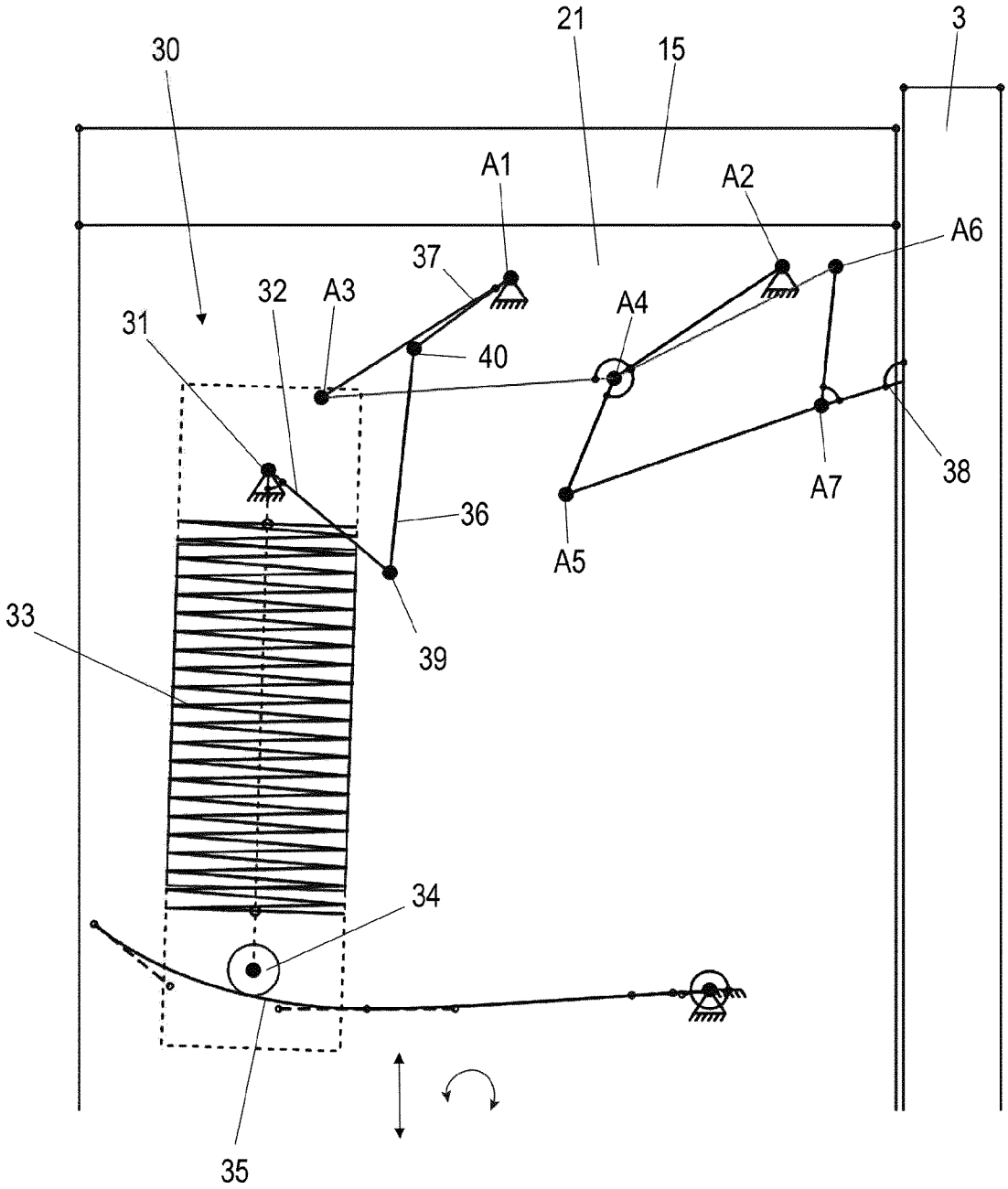
FIGS. 6A to 6G show several views of a pivot drive in different positions according to a first embodiment example.

FIG. 6A shows a schematic representation of the fitting with a pivot drive 30 according to the invention which is arranged in the housing 21. The fitting 20 is designed as a seven-joint hinge and comprises two axes of rotation A1 and A2 arranged stationary on the housing 21, which form a joint connection via joints with five further axes of rotation A3 to A7, to which the flap 3 is fixed at a connection 38. Such multiple-joint connections are known by different variations and thus are shown only schematically.

The pivot drive 30 comprises an actuating arm 32 which is mounted so as to be rotatable about an axis of rotation 31 which is arranged stationary on the housing 21. The actuating arm 32 is connected via a movable joint 39 to a joint lever 36, which is connected via a further joint 40 to a lever 37 of the multi-joint arrangement. The lever 37 is designed as a double lever so that the pivot point A3 and the joint 40 are always pivoted at the same distance around the axis of rotation A1.

The actuating arm 32 is non-rotatably connected to a spring assembly 33, which comprises one or more springs that are linearly movable and can be compressed and expanded on a linear guide, e.g. by rods, sleeves or other linear guide elements. The spring assembly 33 is mounted on one side of an axis of rotation 31. On the other side of the spring assembly 33, the spring assembly 33 acts on a pressure-exerting component 34. The pressure-exerting component 34 is designed as a roller, especially made of metal, and can be moved along a control curve 35. The control curve 35 is adjustable in the housing 21 and is preferably also made of metal, for example steel.

The control curve 35 can be adjusted relative to the axis of rotation 31, as indicated by the two arrows. The control curve 35 can first be compressed or expanded in the direction of action of the spring assembly 33, i.e. in the direction of a line between the axis of rotation 31 and an axis of the pressure-exerting component 34, by adjusting the control curve 35 accordingly. For this purpose, appropriate adjustment means, in particular thread adjustments, eccentrics or screws, can be provided on the control curve, which are supported on the housing 21 and thus enable adjustment of the control curve 35. To achieve the same effect, it is also possible to compress or expand the spring assembly 33 by means of appropriate adjustment means, in particular thread adjustments, eccentrics or screws.

In addition to the linear adjustment, the control curve 35 can also be pivotable, preferably around a pivot point which in a closed position of the fitting lies adjacent to the pressure-exerting component 34. This allows the force exerted by the spring assembly 33 on the actuating arm 32 to be adjusted for different opening positions of flap 3 without having to replace the control curve 35. Since in the case of differently wide flaps different weights act on the actuating arm 32 depending on the opening position, the spring force for different opening positions can be changed by such a pivot adjustment. Preferably, the pivot drive 30 according to the invention comprises both a linear adjustment and a pivot adjustment for the control curve 35, wherein further adjustment options can be optionally provided, for example, individual sections of the control curve 35 can be adjusted relative to each other.

Figure 6B:
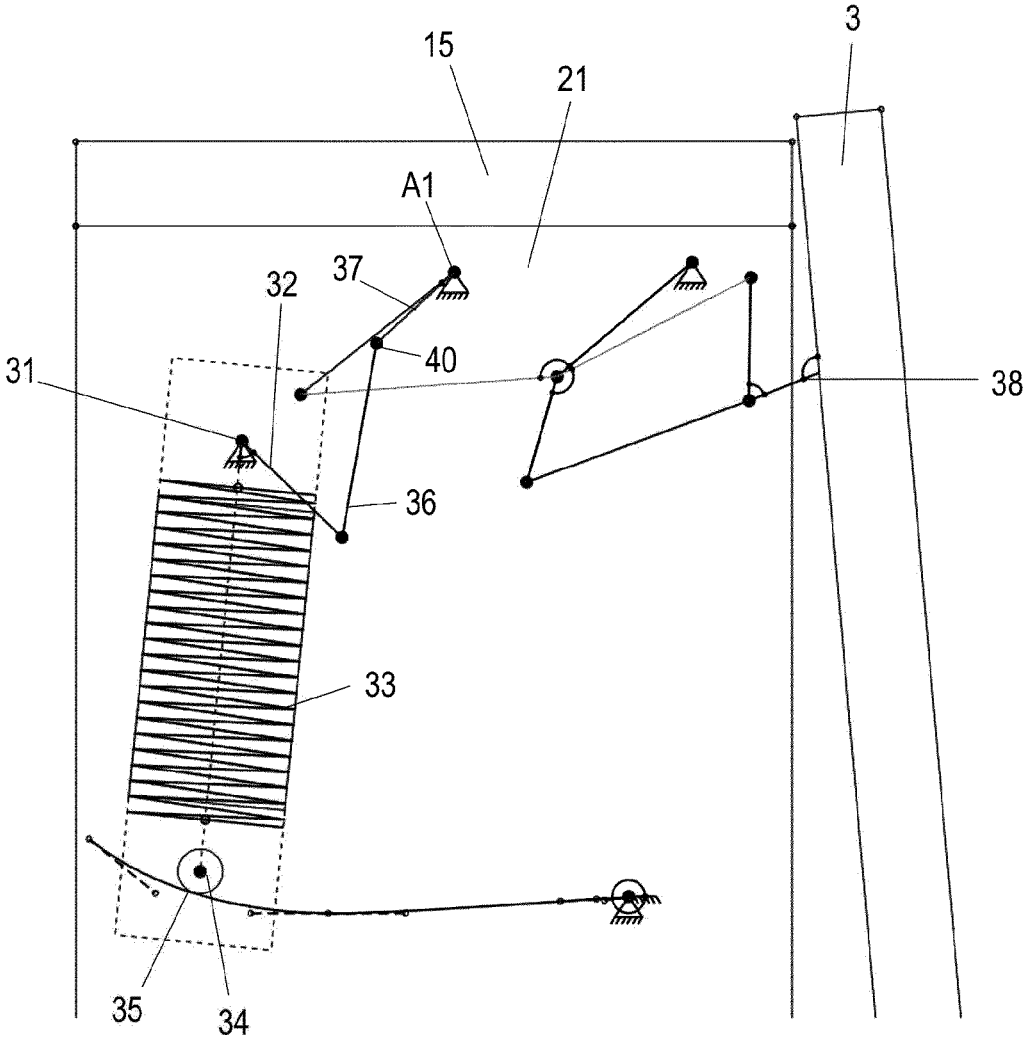
Figure 6C:
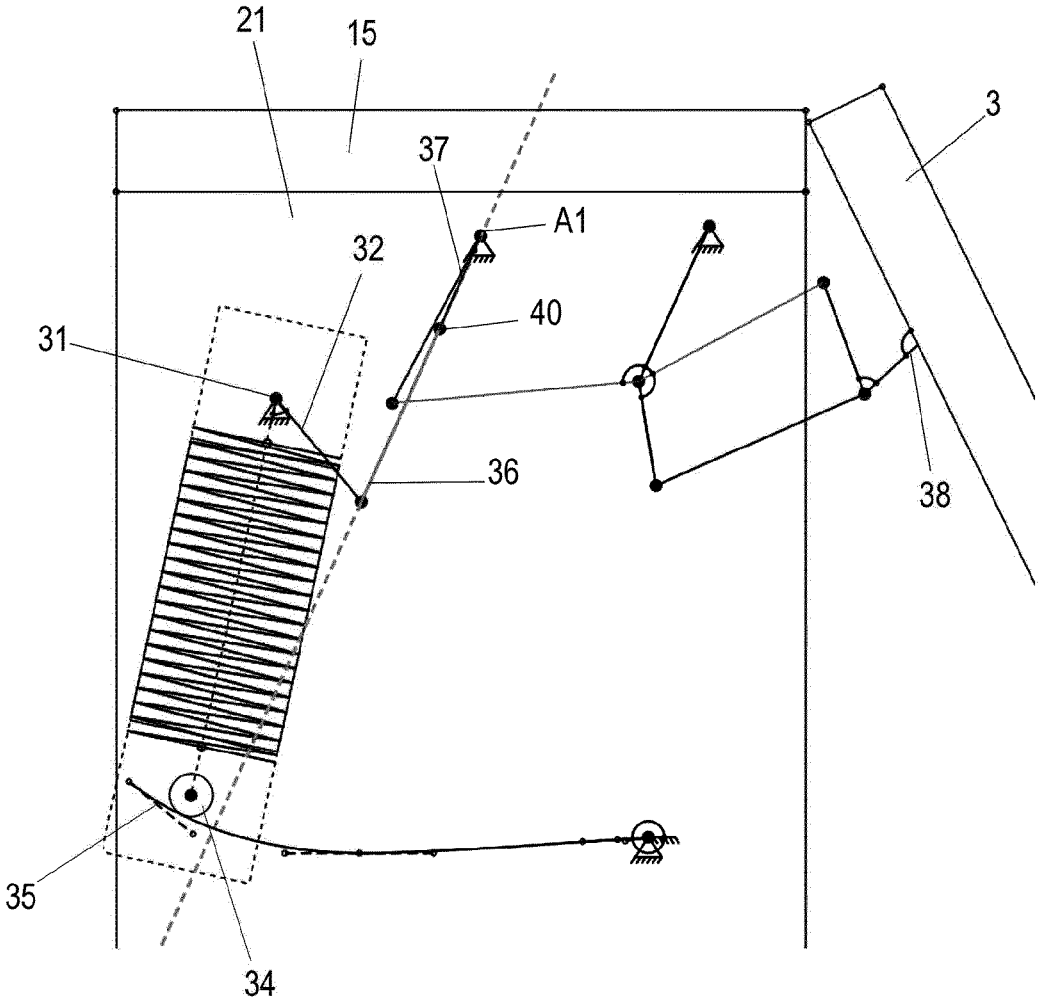
Figure 6D:
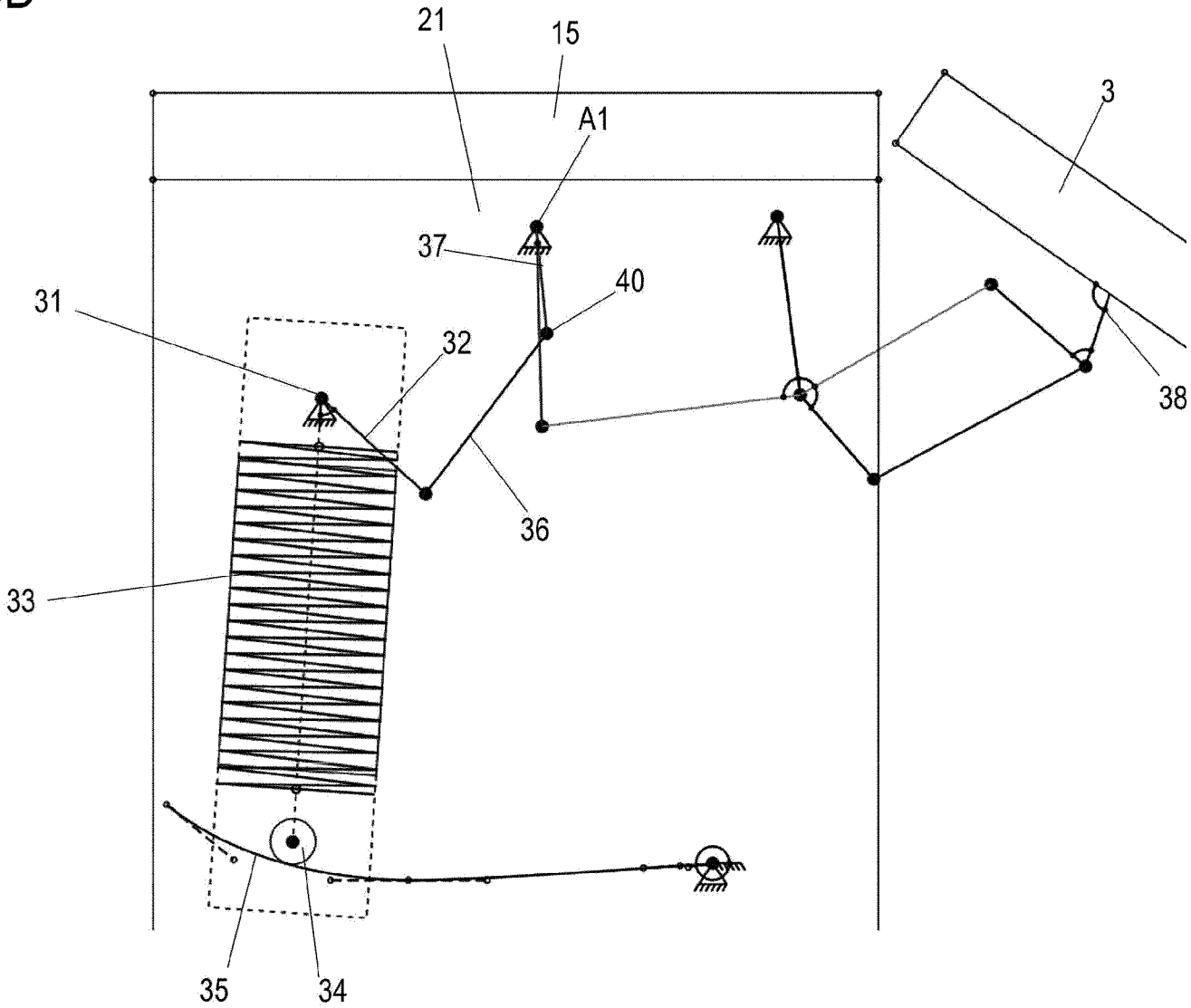

FIG. 6A shows the closed position of flap 3, in which it essentially vertically covers an opening in furniture body 2. When flap 3 is pivoted in the opening direction as shown in FIG. 6B, the multi-joint arrangement with lever 37 moves counterclockwise about the axis of rotation A1 and a compressive force is transmitted to the joint lever 36, causing the actuating arm 32 to rotate clockwise through the axis of rotation 31. As a result, the pressure-exerting component 34 also moves clockwise along the control curve, which extends in a curved manner towards the spring assembly 33, so that when the spring assembly 33 moves clockwise, the pressure-exerting component 34 is pressed against the spring assembly 33, so that when the flap 3 is opened, the forces act in the closing direction and must be overcome by the user when opening the flap 3. Flap 3 is moved further in the opening direction according to FIG. 6C, and in a predetermined opening position, for example at an angle of flap 3 between 20° to 30° to the closing position, a dead center is passed through. In the area of the dead center, the joint 40 is located on a line that runs through the axis of rotation A1 and the joint lever 36. The pressure-exerting component 34 was moved along the control curve 35 to a maximum position. If flap 3 is moved further in the opening direction from the dead center position shown in FIG. 6C, as shown in FIG. 6D, the joint lever 36 is pulled over the joint 40 by turning the double lever 37 counterclockwise, so that the actuating arm 32 is now turned counterclockwise around the axis of rotation 31. This causes the pressure-exerting component 34 to move back again along the control curve 35, and the spring assembly 33 is relaxed during this movement so that the movement of the flap 3 is supported by the spring assembly 33.

Figure 6E:
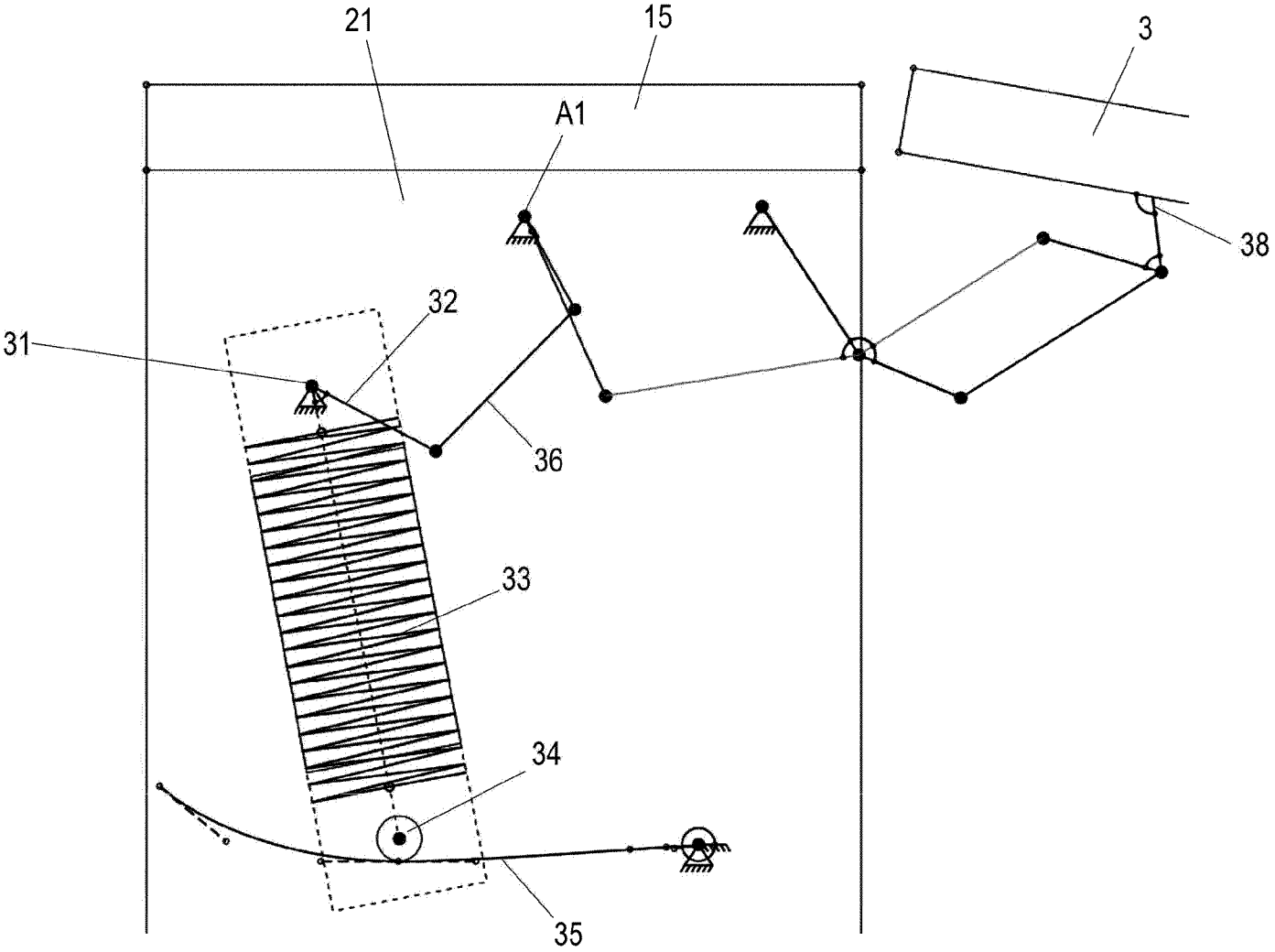
Figure 6F:
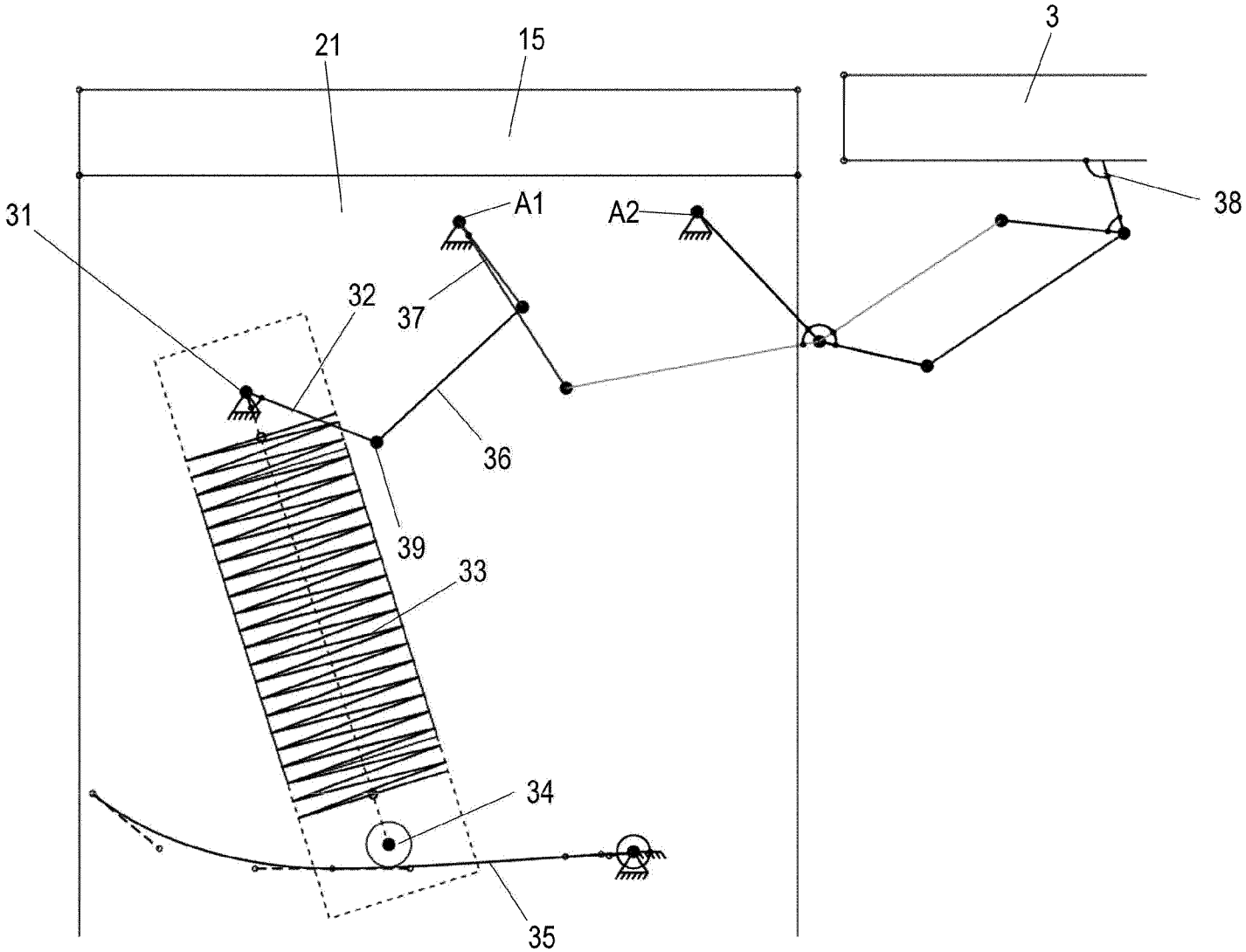
Figure 6G:
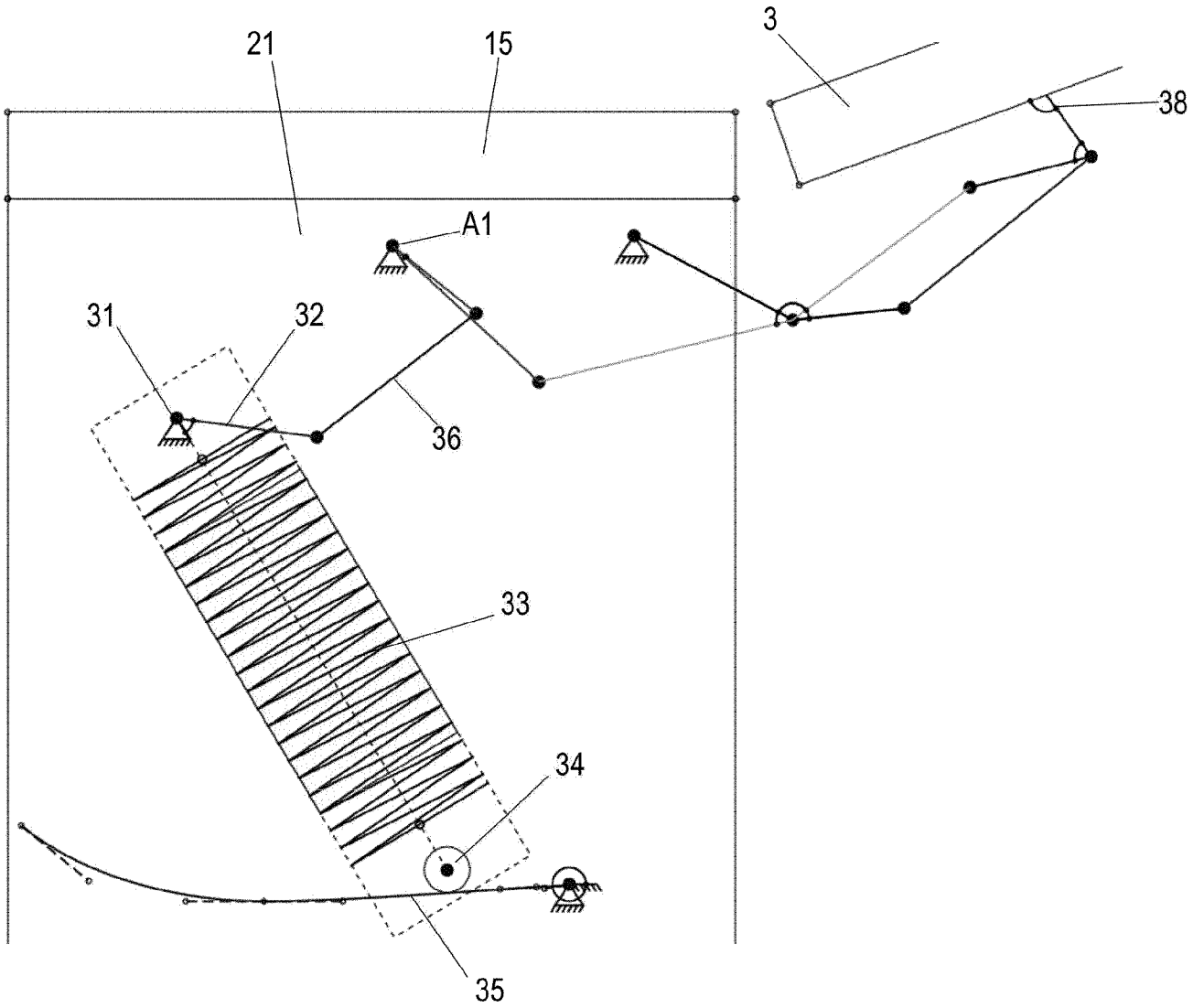
Figure 7A:
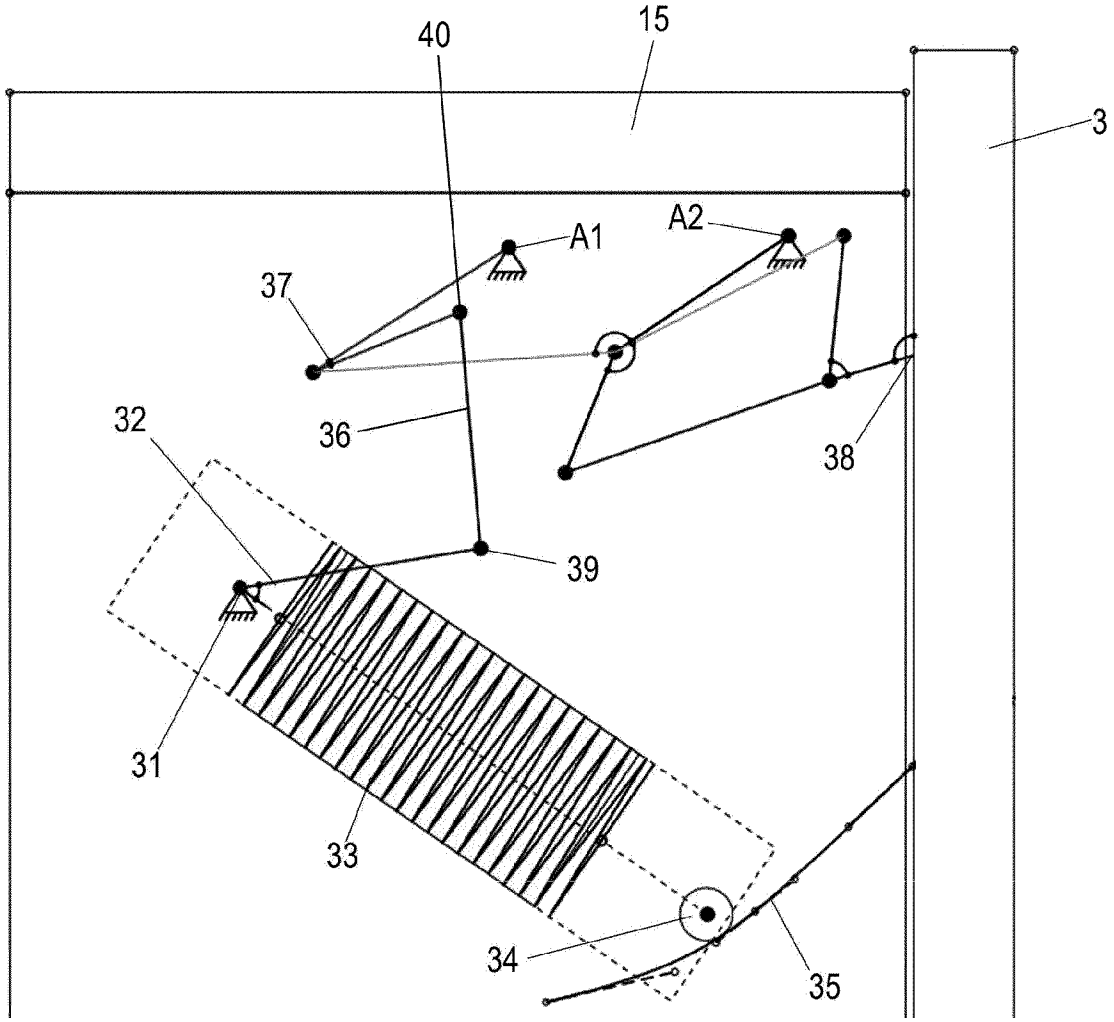
FIGS. 7A to 7D show several views of a pivot drive in different positions according to a second embodiment example.
Figure 7B:
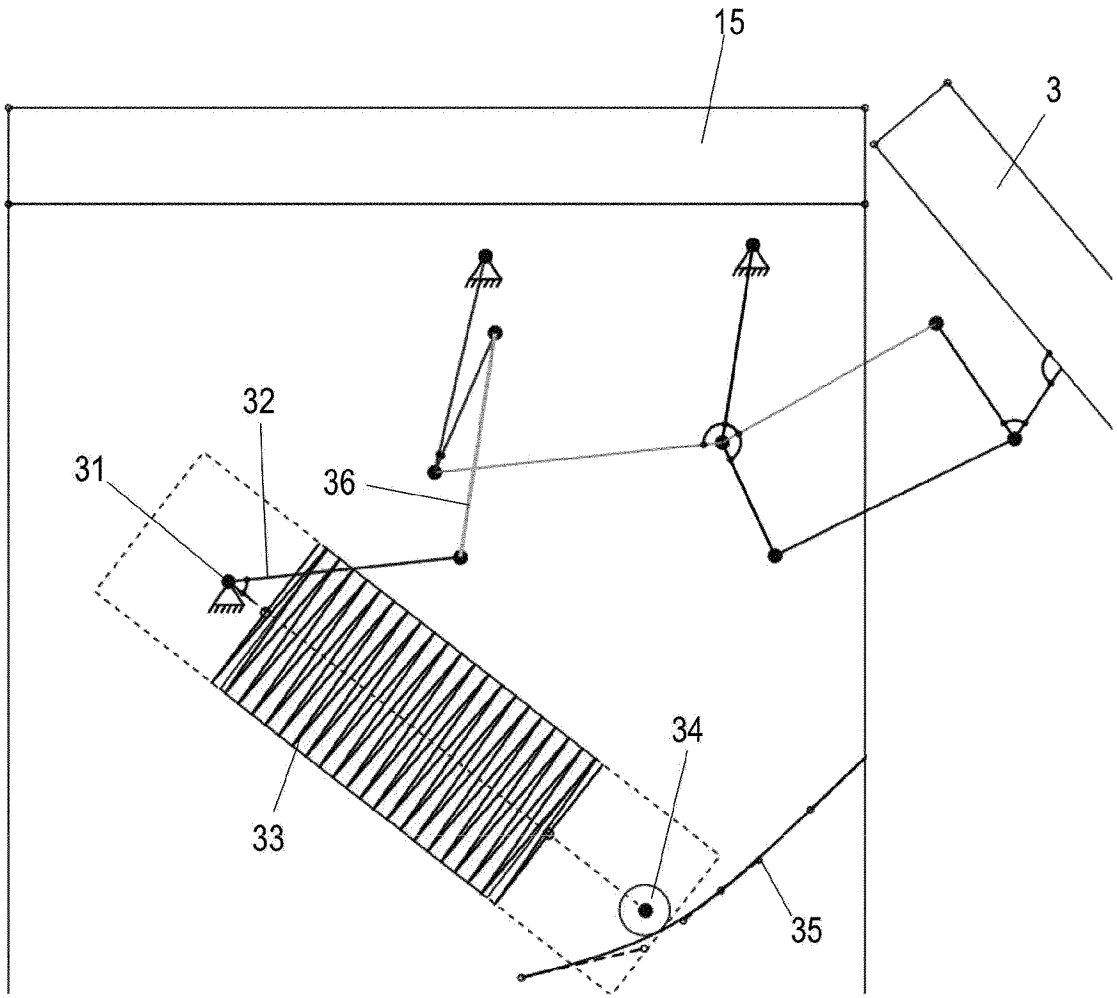
Figure 7C:
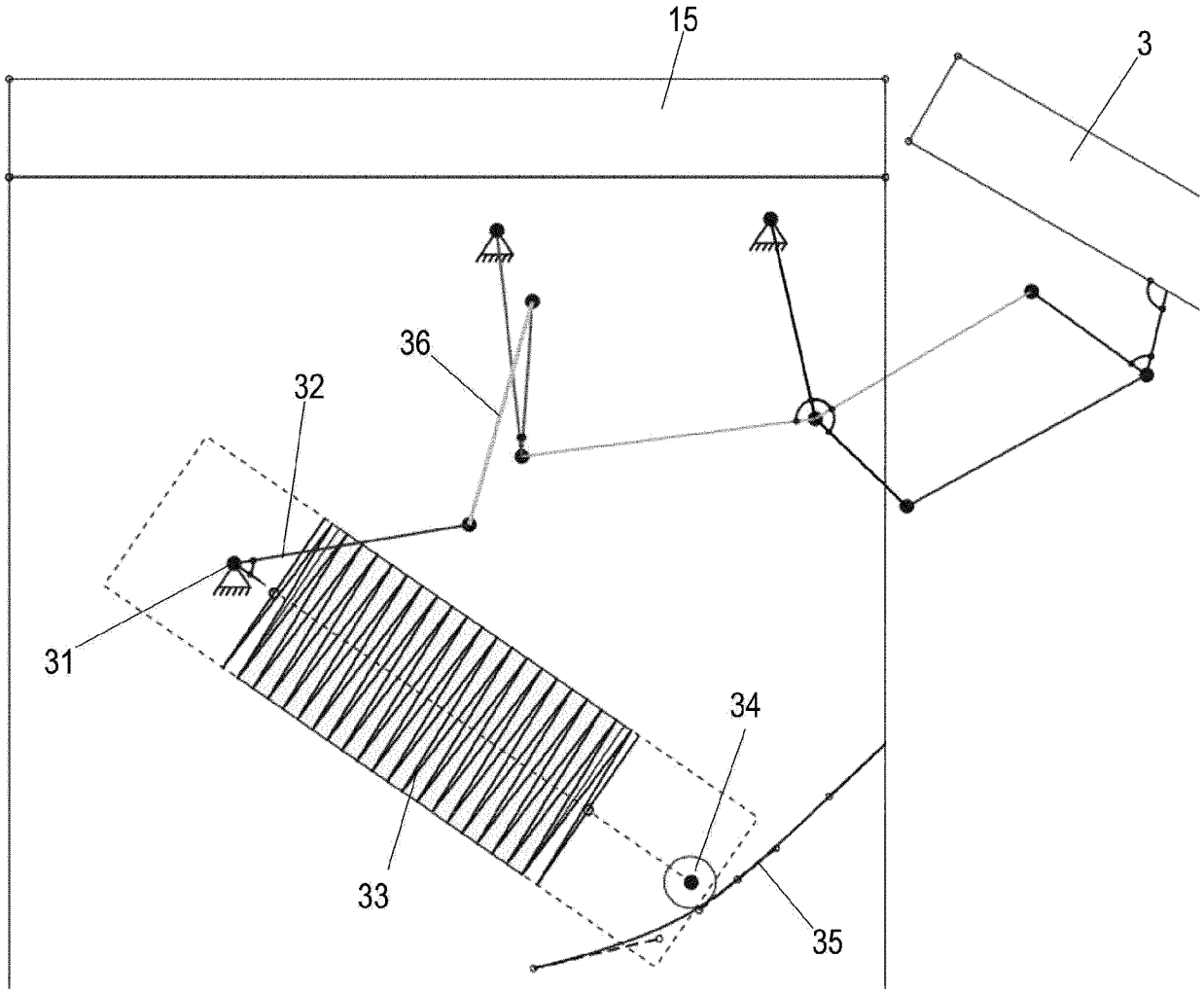
Figure 7D:
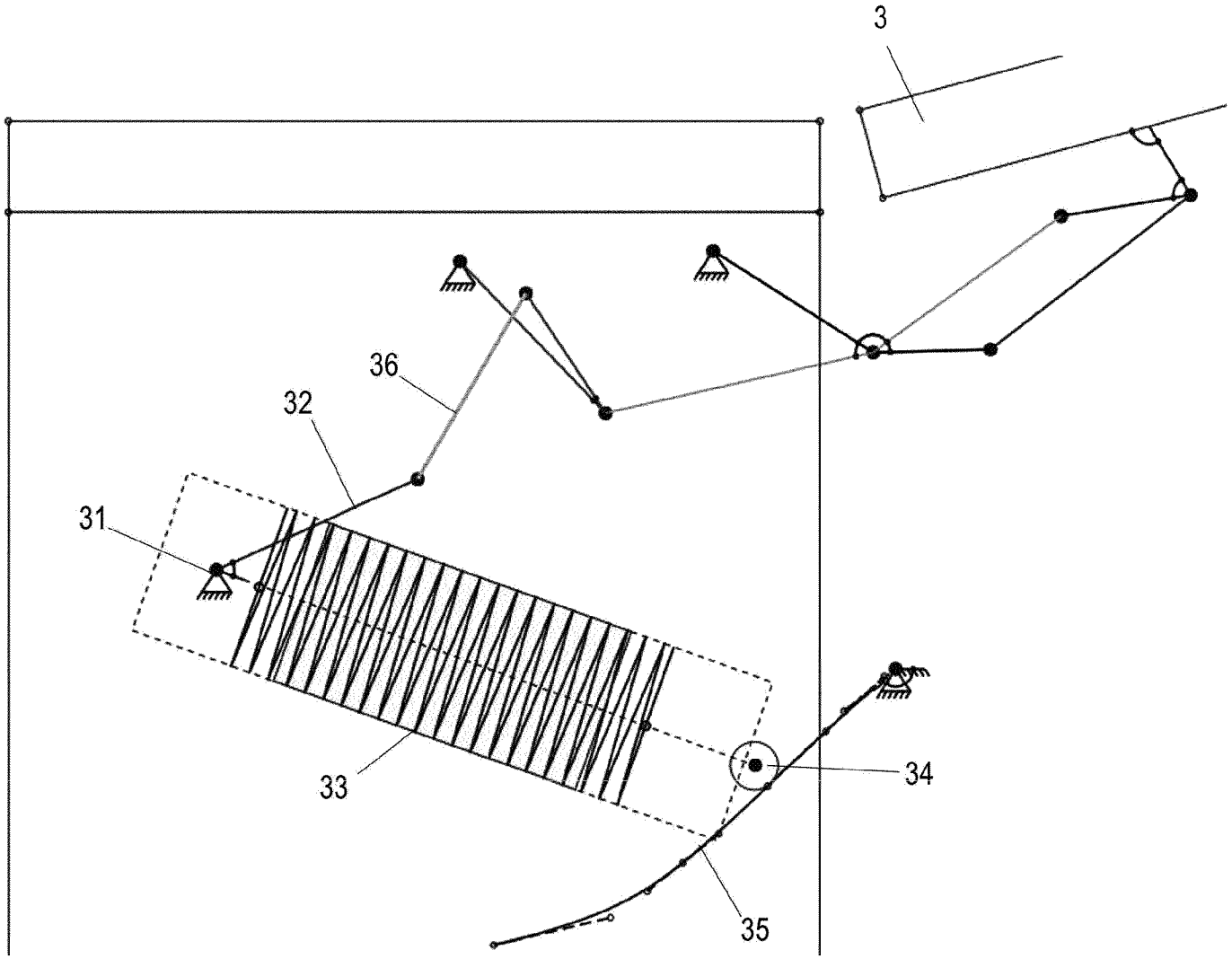
Figure 8A:
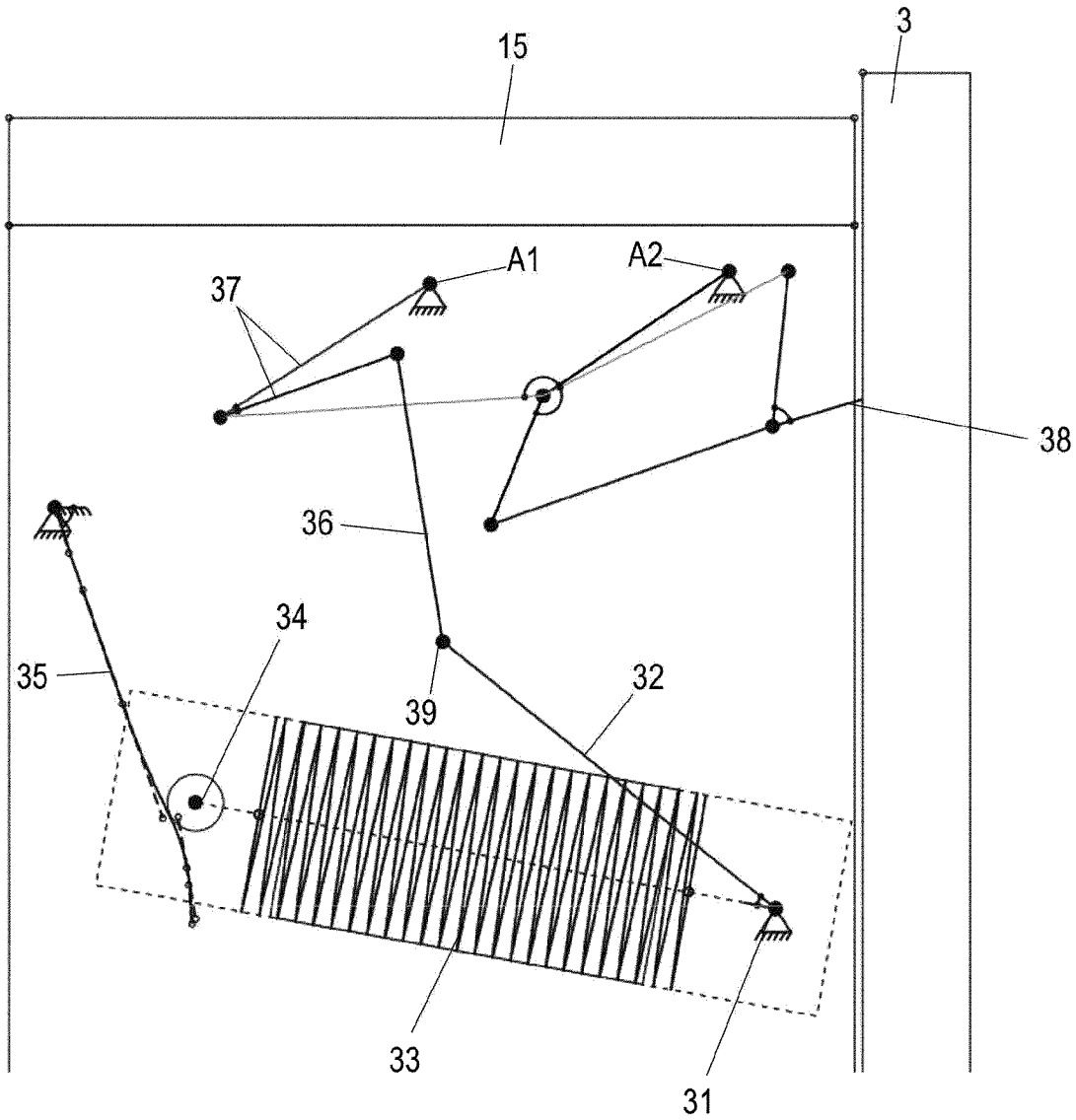
FIGS. 8A to 8D show several views of a pivot drive in different positions according to a third embodiment example.
Figure 8B:
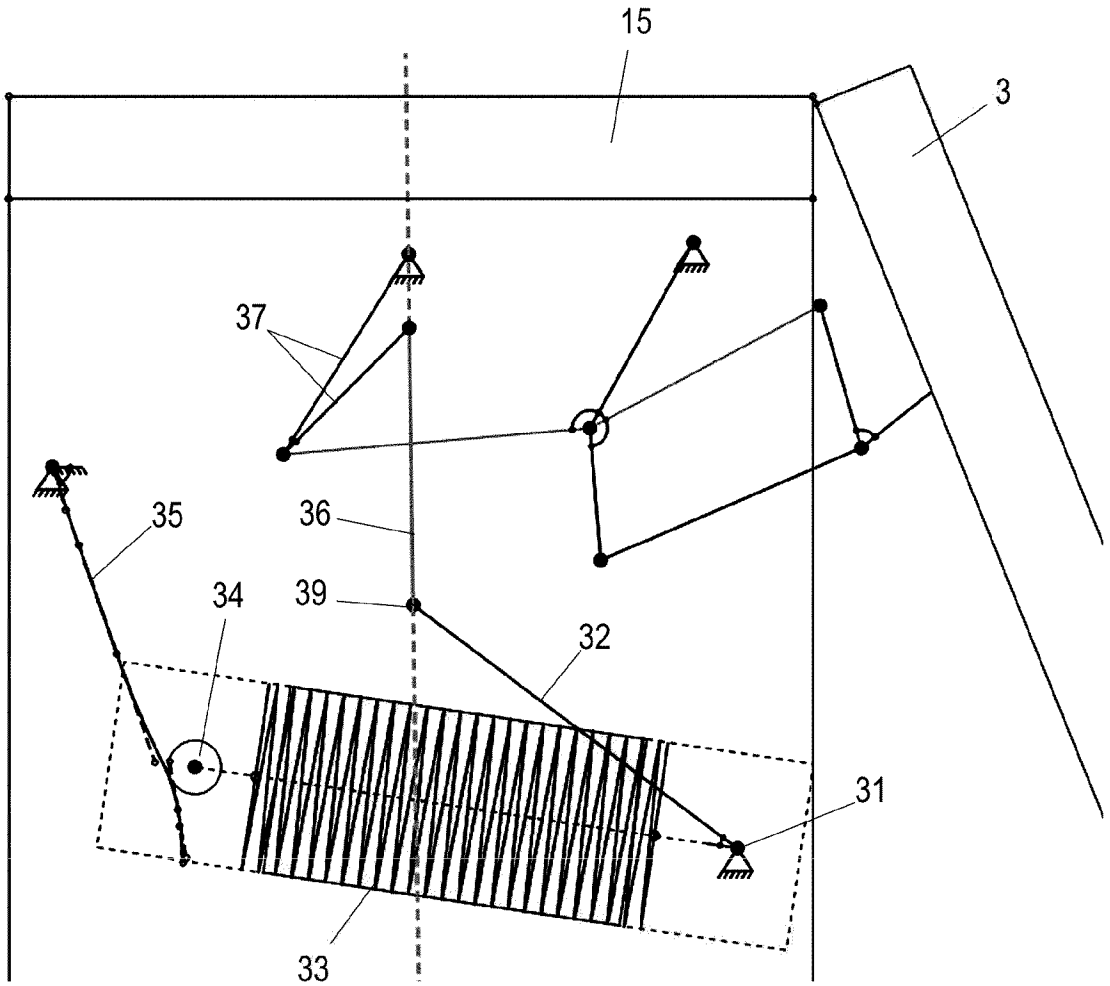
Figure 8C:
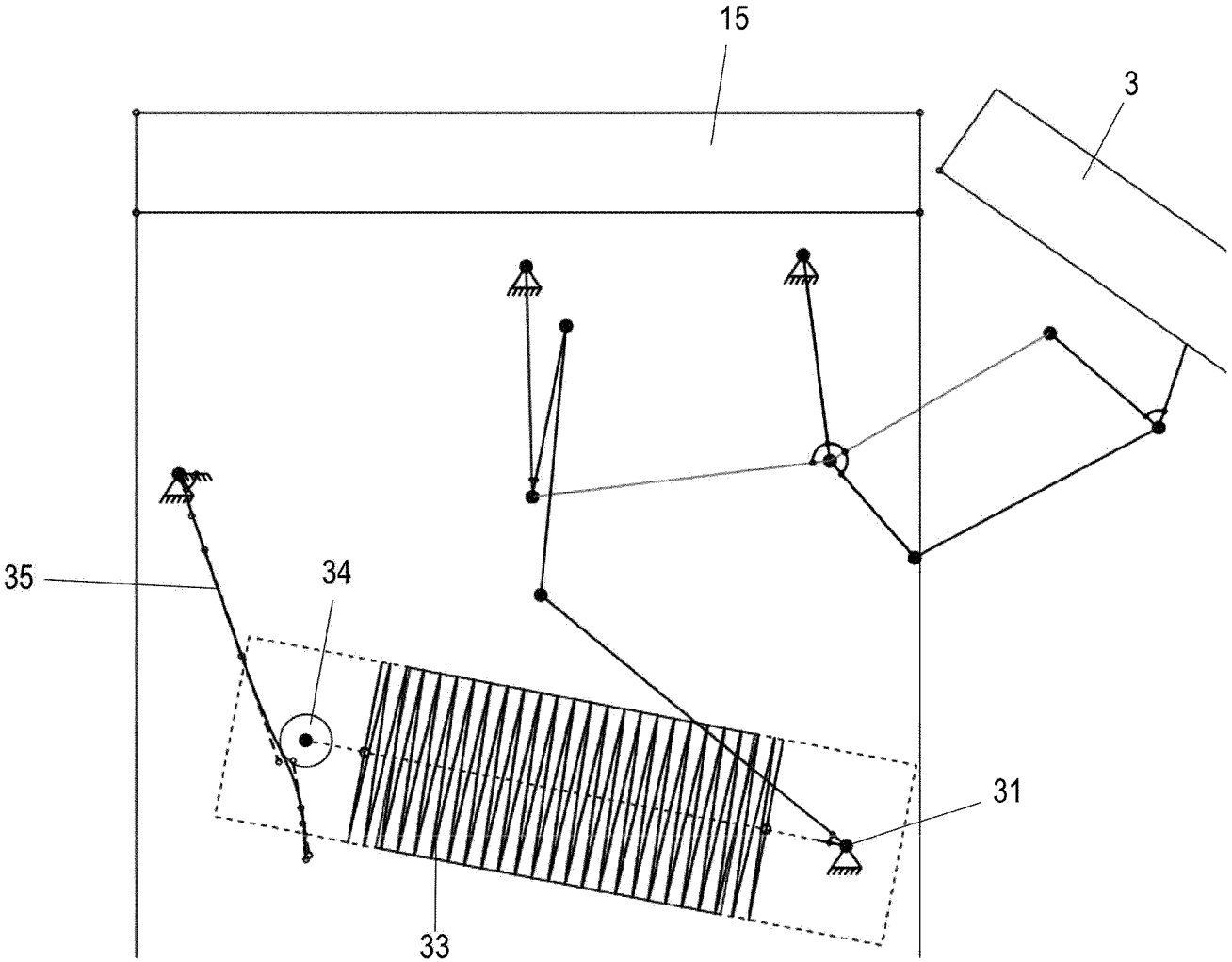
Figure 8D:
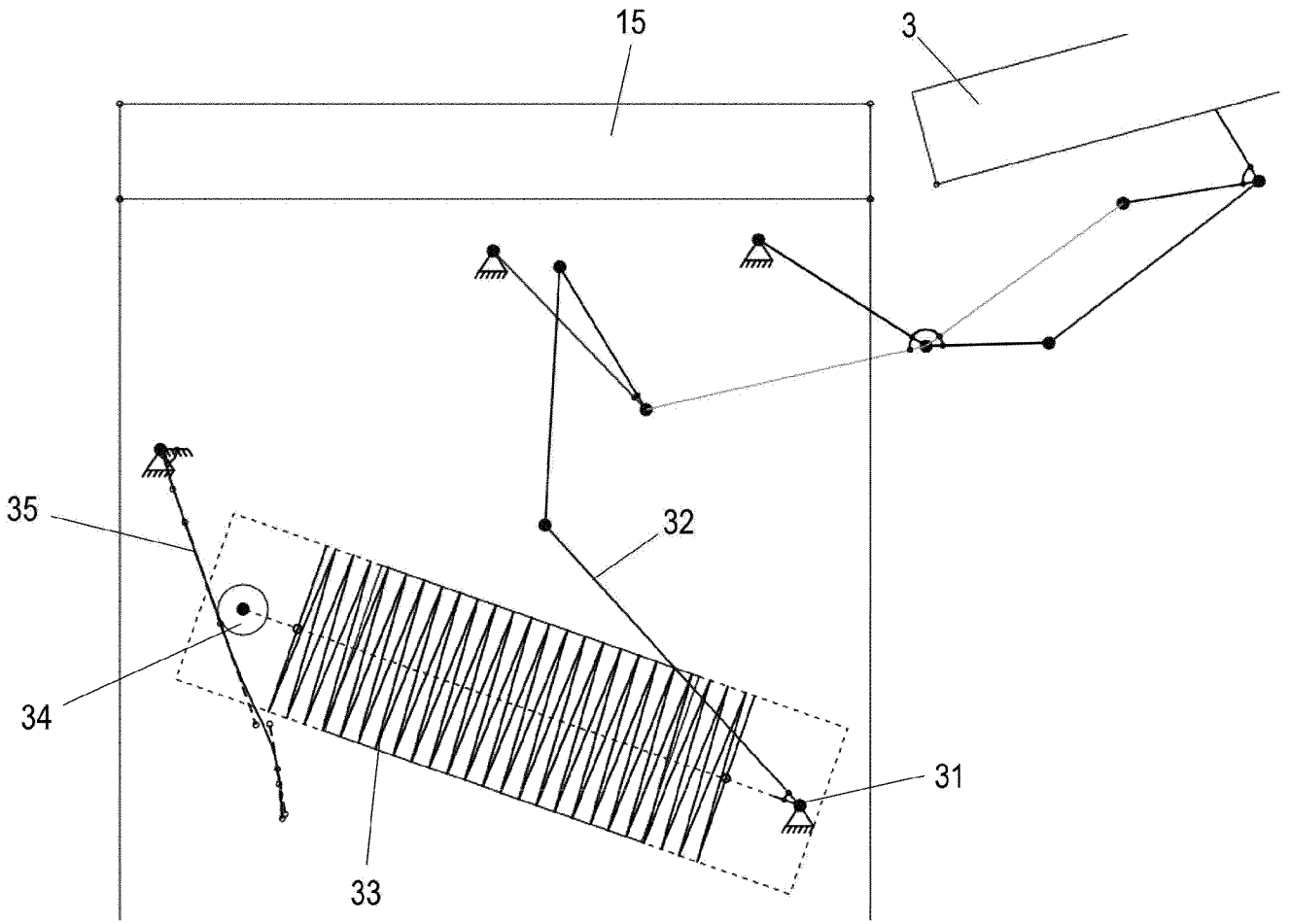
Figure 9A:
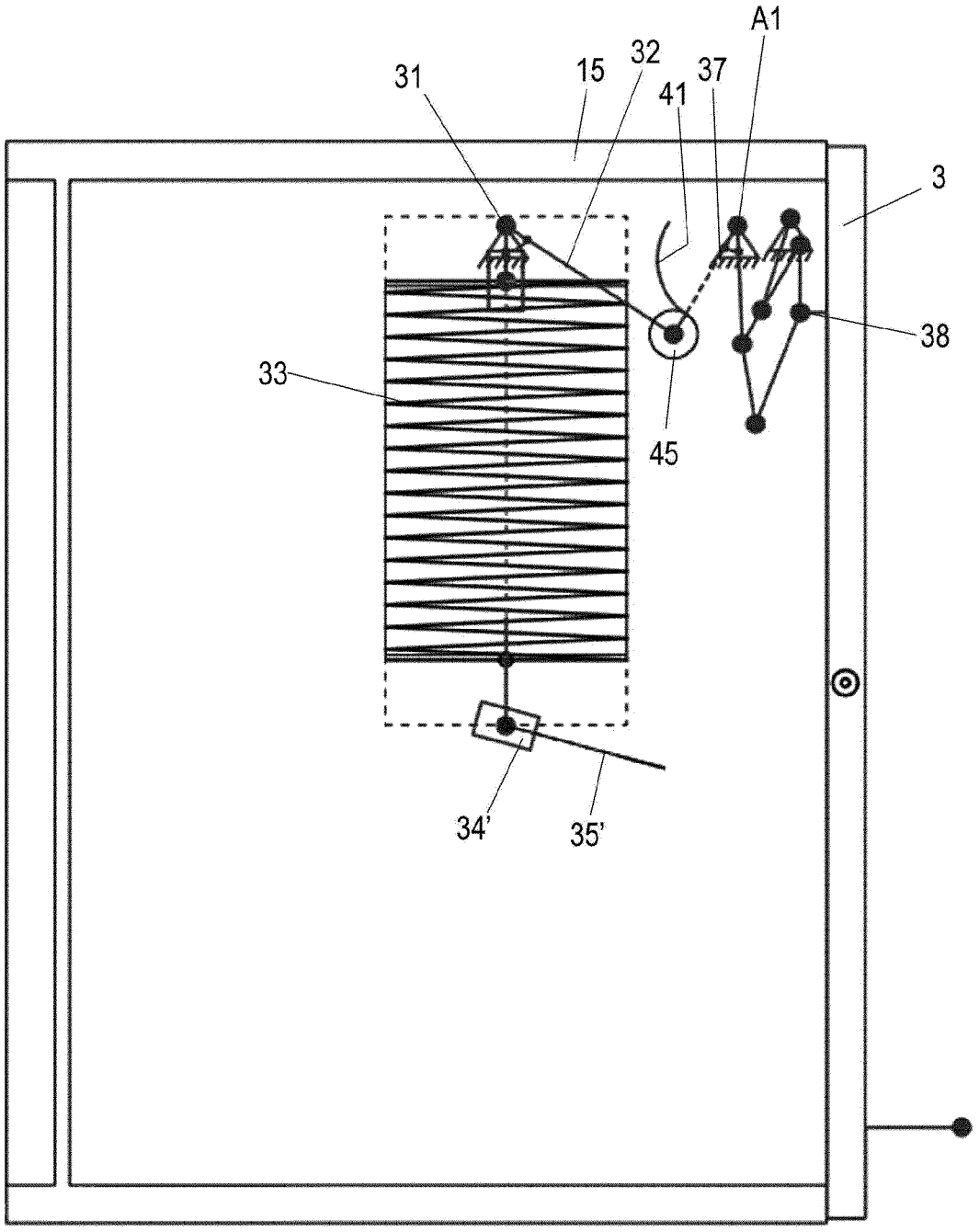
FIGS. 9A to 9D show several views of a pivot drive in different positions according to a fourth embodiment example.
Figure 9B:
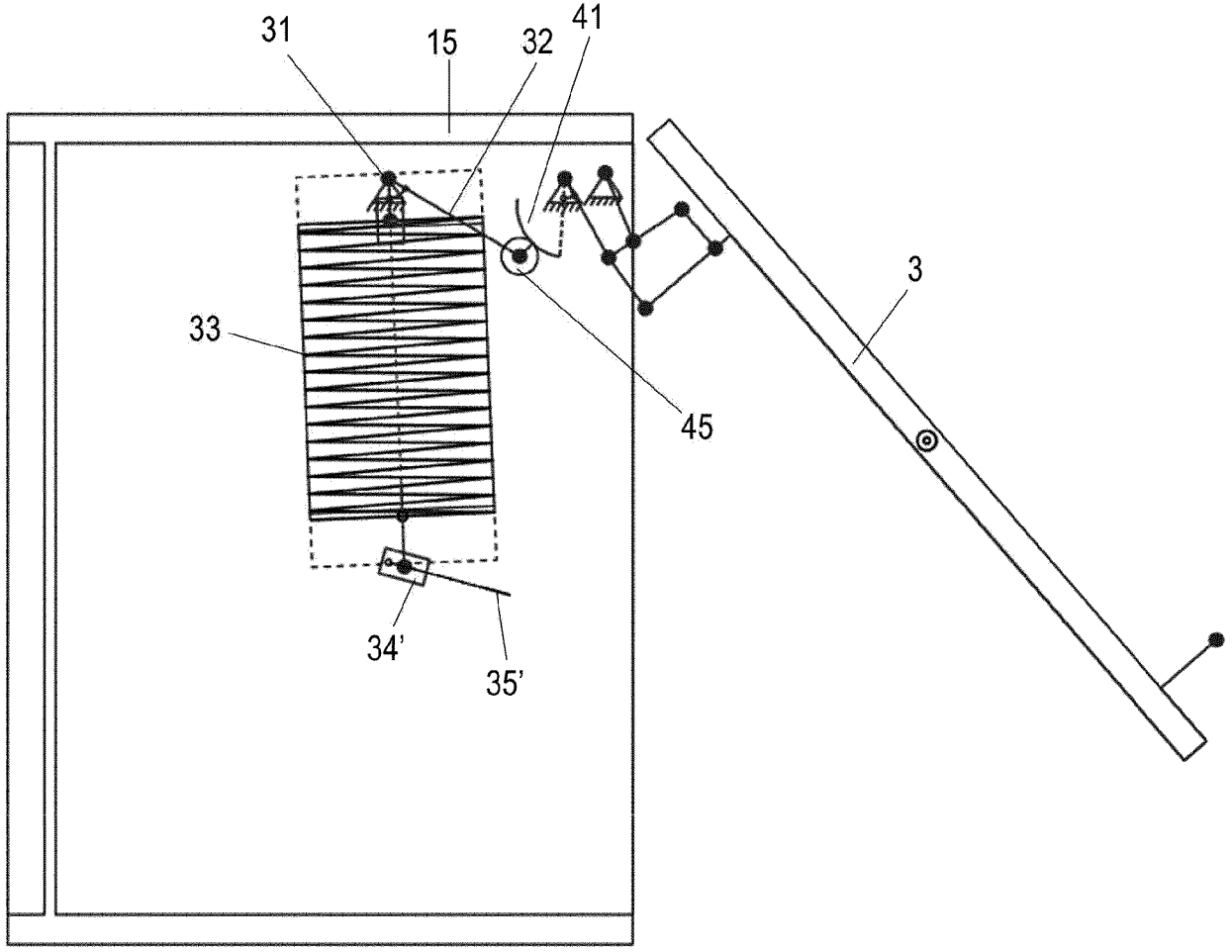
Figure 9C:
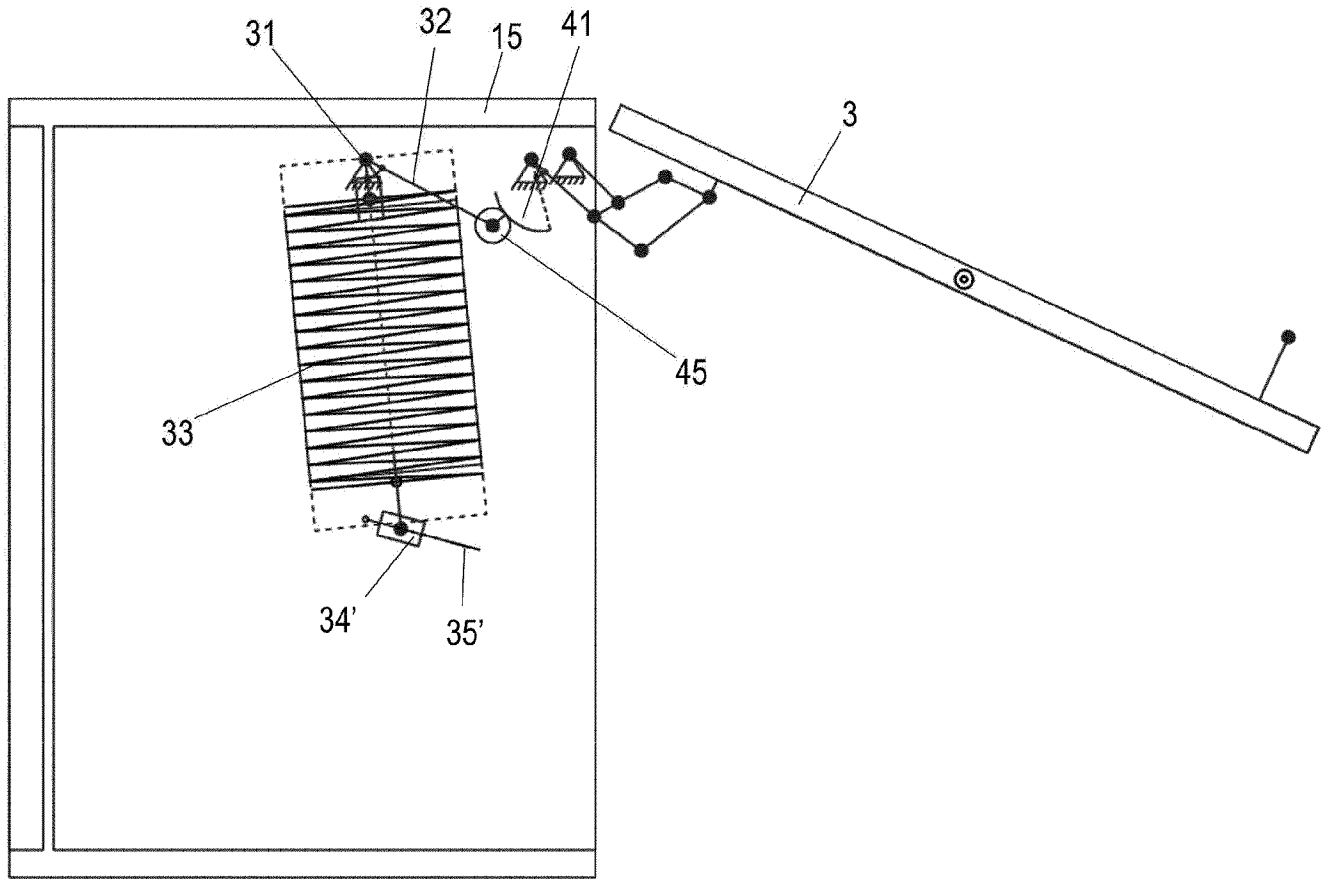
Figure 9D:
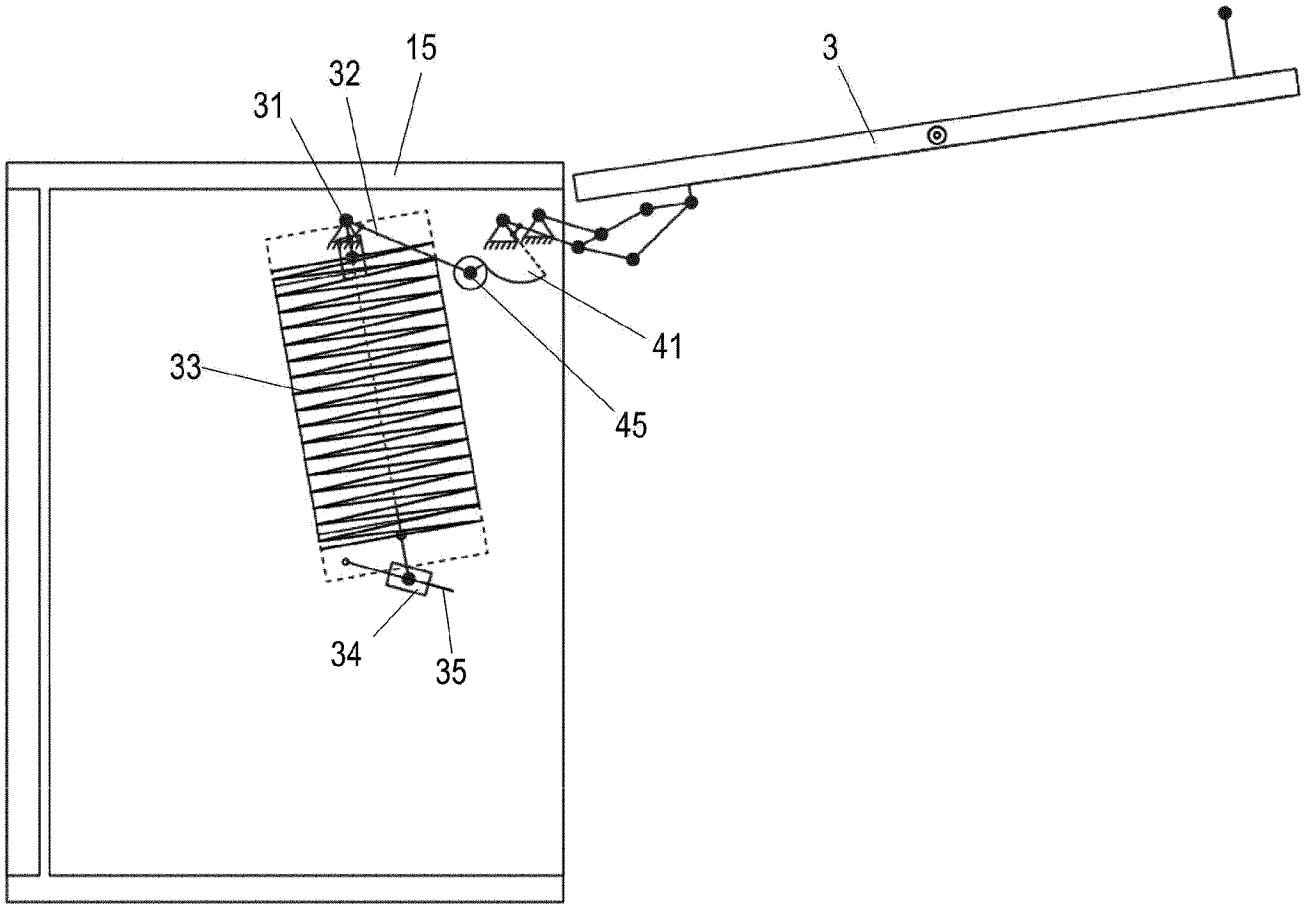

Flap 3 can now be moved further in the opening direction as shown in FIGS. 6E, 6F and 6G, for example up to a maximum opening position of 100° to 120° relative to the closing position. During this rotation, the actuating arm 32 is pivoted counterclockwise and the pressure-exerting component 34 moves accordingly along the control curve 35, which is designed so that the spring assembly 33 relaxes during this rotation. Thus the weight force applied to the fitting by the flap 3 is at least partially compensated by the spring assembly 33, wherein it is possible to adjust the spring assembly 33 with the actuating arm 32 in such a way that the weight force of the flap 3 is completely compensated and the user essentially only has to apply the forces for moving the flap 3. The forces of the spring assembly 33 can also be adjusted so that the flap opens automatically from a certain opening angle. The control curve can also be designed, independently of the spring assembly 33, in such a way that the flap opens automatically from a certain opening angle.

The flap 3 is positively guided relative to the pivot drive 30 so that the counter-rotating movements are carried out during a closing movement. First, when closing from the position shown in FIG. 6G to the position shown in FIG. 6C, forces must be applied by the user to compress the spring assembly 33 again, which is pivoted about the axis of rotation 31 and compressed by the pressure-exerting component 34 and the control curve 35. When the dead center is reached, no force is transmitted to the actuating arm 32 via the spring assembly 33, and the spring assembly 33 does not act in the closing direction until a further closing movement. Flap 3 can be pretensioned in a closing range of 0° to 20° or 0° to 30°, for example, in the closing direction via the pivot drive 30 and is pretensioned in an opening range adjacent to this closing range via the pivot drive 30 in the opening direction.

Optionally, the pivot drive 30 can have a damper, for example a linear damper, which ensures that the flap 3 is braked before reaching the closing position and/or the maximum opening position so that no loud stop noises occur. Such a damper can, for example, be attached to the spring assembly 33 or the actuating arm 32 or to the housing 21 to dampen the pivoting movement of the spring assembly.

In the following embodiment examples, further pivot drives are shown, wherein identical components are designated with the same reference numerals as in the embodiment example in FIG. 6. Therefore only the differences to the embodiment example shown in FIG. 6 are discussed in detail.

In the embodiment example shown in FIGS. 7A to 7D, the spring assembly 33 in the closing position of flap 3 is no longer arranged essentially vertically with the direction of action, but diagonally. This allows the pressure-exerting component 34 and the control curve 35 to be positioned closer to the flap 3, making it easier to operate an adjustment mechanism from a front side of the furniture body. The actuating arm 32 is otherwise coupled to the multi-joint connection, which also holds flap 3, via a joint lever 36, as in the previous example. In addition, the function of the pivot drive with the spring assembly 33, which acts on the pressure-exerting component 34, which can be moved along the control curve 35, is the same as in the previous embodiment examples.

FIGS. 8A to 8D show another embodiment example of a pivot drive in which the actuating arm 32 is connected to the flap 3 again via a joint lever 36 having a multi-joint connection. Compared with the other embodiment examples, the spring assembly 33 is arranged rotated in the housing 21 of the fitting 20, with the pressure-exerting component 34 and the control curve 35 facing the rear of the furniture body. The axis of rotation 31 of the actuating arm 32, on the other hand, is adjacent to the flap 3.

FIGS. 9A to 9D show another embodiment example of a pivot fitting in which a modified control curve 35' is provided to guide a modified pressure-exerting component 34'. The control curve 35' is designed as a linear guide which is inclined to the direction of action of the spring assembly 33 so that when the pressure-exerting component 34' moves relative to the control curve 35', the spring assembly 33 is relaxed or tensioned.

In the embodiment example of FIGS. 9A to 9D, no dead center is passed when the flap 3 is opened, but the pressure-exerting component 34' moves linearly along the control curve 35' over the entire pivot range, so that the spring assembly 33 moves only in one direction during the opening movement. The arrangement of the actuating arm 32 and the connection between the actuating arm 32 and the lever 37 can generate a change in direction of the closing and opening force.

In addition, in the embodiment example shown in FIGS. 9A to 9D, the pivot drive 30 is not coupled via a joint 40, but a further pressure-exerting component 45 is provided on the actuating arm 32, for example a roller that can be moved along a curve guide 41. The curve guide 41 is non-rotationally connected to a lever 37 of the multi-joint arrangement, and by turning the curve guide 41 around the axis of rotation A1, the pressure-exerting component 45 and thus the actuating arm 32 is pivoted. When flap 3 is opened, the curve guide 41 pivots counterclockwise and the actuating arm 32 thus also pivots counterclockwise.

Figure 10A:
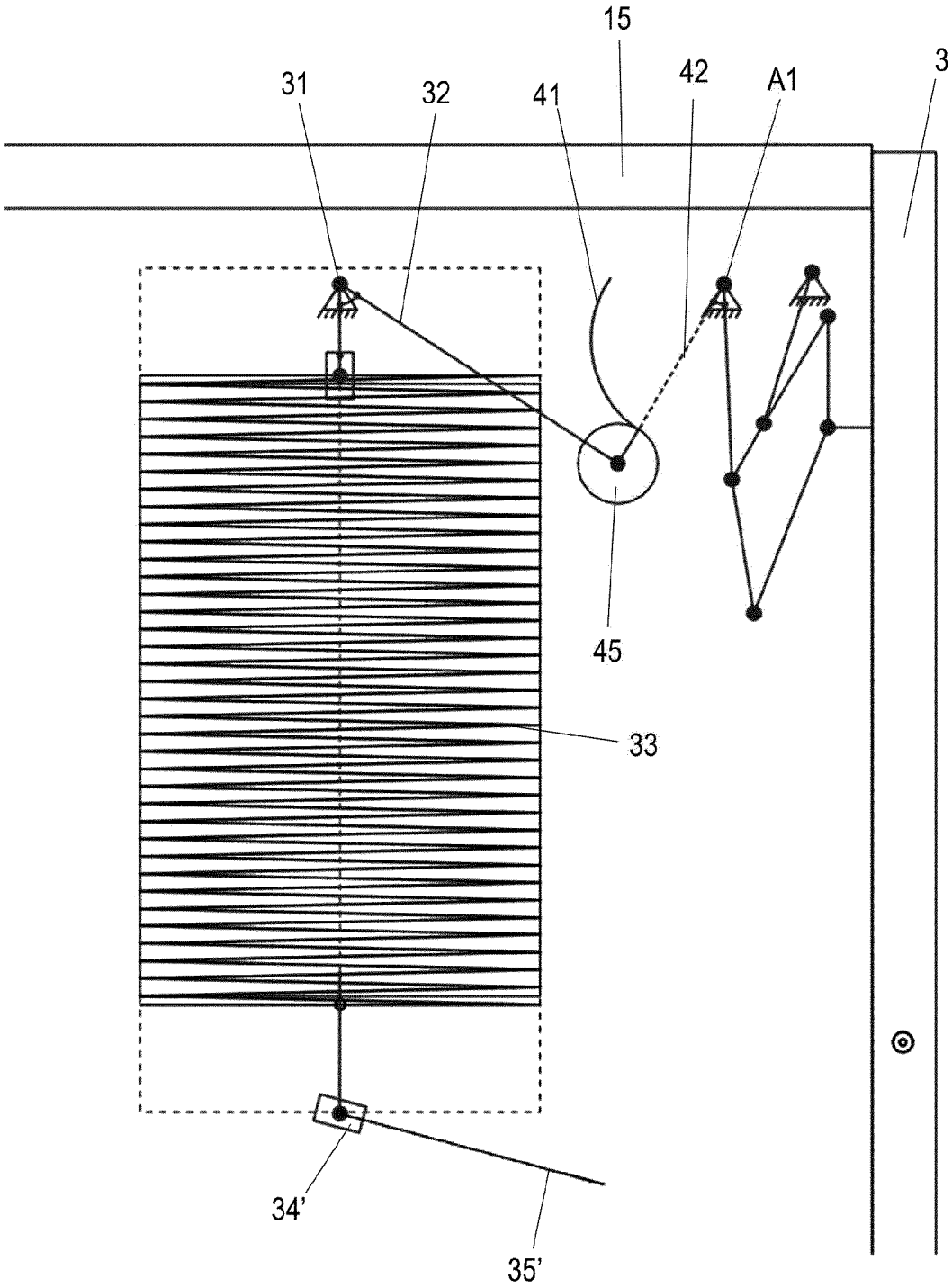
FIGS. 10A to 10C show several views of a pivot drive in different positions according to a fifth embodiment example.
Figure 10B:
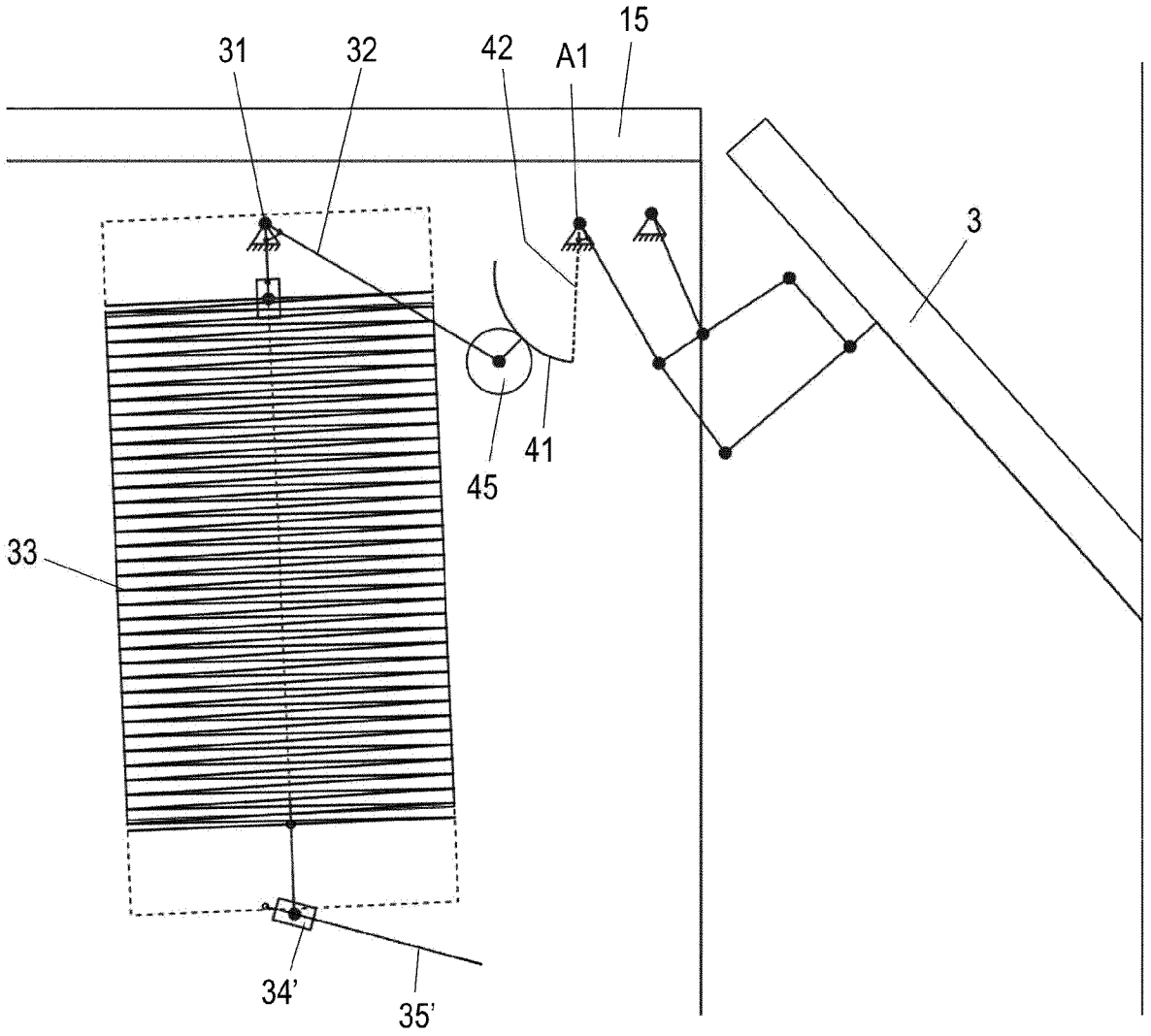
Figure 10C:
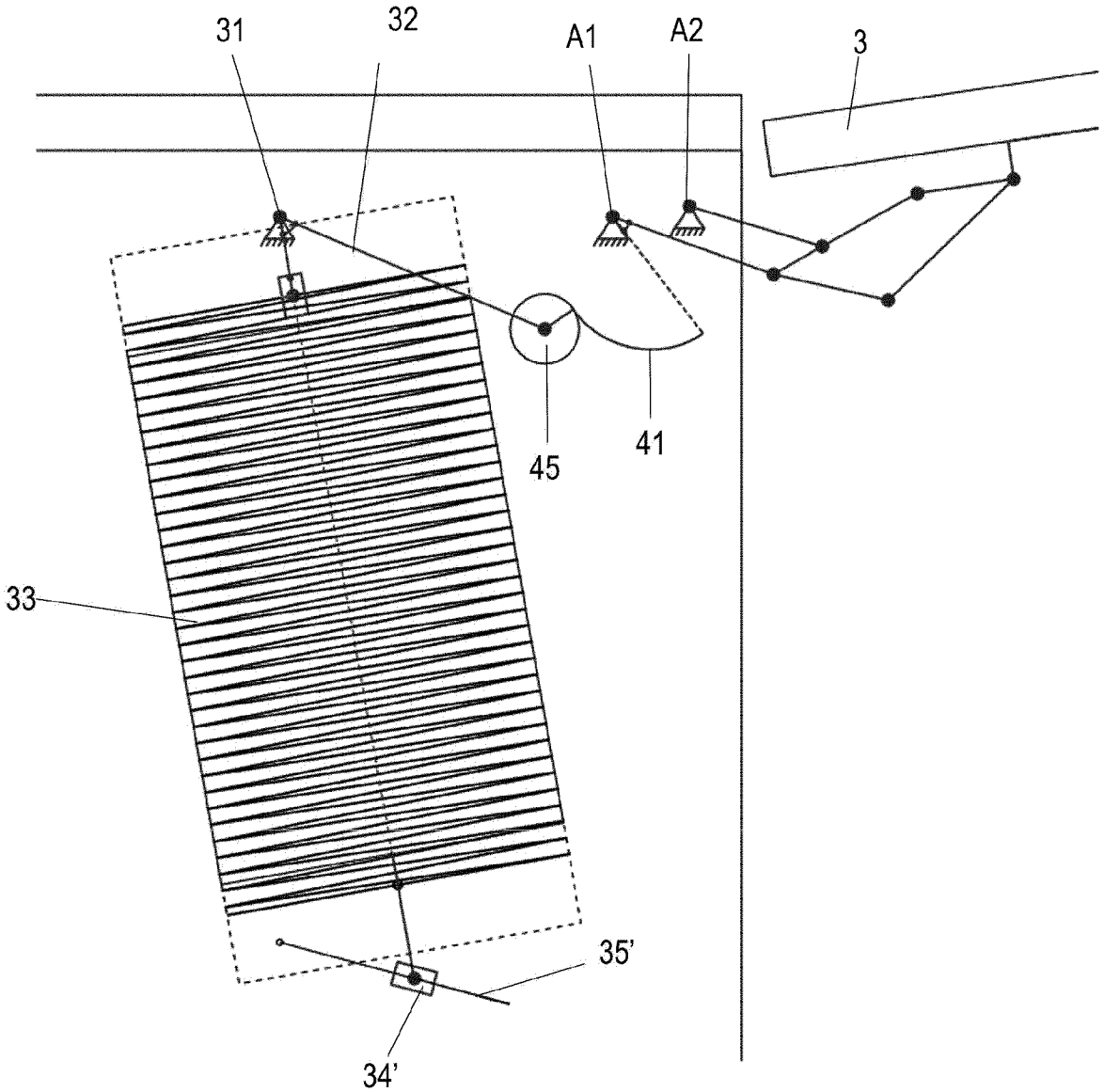

FIGS. 10A to 10C show another embodiment example in which a spring assembly 33 is coupled in a rotationally fixed manner to an actuating arm 32, to which a pressure-exerting component 45 is fixed. The pressure-exerting component 45 can again be moved along a curve guide 41, which is pivoted counterclockwise when the flap is opened. The position of the spring assembly 33 and the dimensioning are different from the embodiment example shown in FIG. 9.

The embodiment examples shown can be combined as required to modify the transmission mechanism from flap 3 or another movable furniture part to the control curve 35' or 35'.

LIST OF REFERENCE NUMERALS

1 Furniture
2 Furniture body
3 Flap
4 Flap fitting
5, 5' Levers
6, 6' Levers
7, 7' Connection
10 Side wall
11 Core
12 Recess
13 Cover layer
14 Base
15 Upper panel
20 Fitting
21 Housing
22 Arm
23 Axis of rotation
24 Arm
25, 25' Flap part
26, 26' Flap part
27 Receptacle
30 Pivot drive
31 Axis of rotation
32 Actuating arm
33 Spring assembly
34, 34' Pressure-exerting component
35, 35' Control curve
36 Joint lever
37 Lever/double lever

38 Connection
39 Joint
40 Joint
41 Curve guide
45 Pressure-exerting component
A1 Axis of rotation
A2 Axis of rotation
A3 Axis of rotation
A4 Axis of rotation
A5 Axis of rotation
A6 Axis of rotation
A7 Axis of rotation

What is claimed is:

1. A piece of furniture comprising a furniture body connected to a movable furniture part having a pivot drive (30), the pivot drive having:

an actuating arm (32) mounted so as to be pivotable about an axis of rotation (31);

a spring assembly (33) having at least one spring guided linearly in one operating direction, a pressure-exerting component (34, 34') connected to the spring assembly (33) and movable along a control curve (35, 35'), a housing (21) on or in which the pivot drive is mounted, wherein the actuating arm (32) is connected in a rotationally fixed manner to the spring assembly (33) and is pivotable therewith about the axis of rotation (31), wherein the actuating arm (32) is connected to the movable furniture part via a multi-joint connection, wherein the control curve is immovable relative to the housing during an opening and/or closing movement of the movable furniture part, so that the furniture body, the control curve and the housing are stationary while the movable furniture part and the spring assembly are moving.

2. The piece of furniture according to claim 1, wherein the spring assembly (33) pretensions the actuating arm (32) in a closing region in a closing direction, and in an opening region next to the closing region, the spring assembly (33) pretensions the actuating arm (32) in an opening direction.

3. The piece of furniture according to claim 1, wherein the movable furniture part is a flap (3) or a door.

4. The piece of furniture according to claim 1, wherein the control curve (35, 35') has a guide track consisting of metal.

5. The piece of furniture according to claim 2, wherein the movable furniture part is kept in balance at least over part of the opening region by the spring assembly (33) and the control curve (35, 41).

6. The piece of furniture according to claim 1, wherein the pressure-exerting component (34, 34') is designed as a roller.

7. The piece of furniture according to claim 1, wherein the spring assembly (30) comprises a plurality of springs which are arranged next to one another and which are guided linearly in a direction of action of the spring assembly.

8. The piece of furniture according to claim 1, wherein the pivot drive is designed as a flap fitting.

9. The piece of furniture according to claim 1, wherein the pivot drive has a damper for braking the actuating arm (32) before a closed position and/or a maximum opening position.

10. The piece of furniture according to claim 1, wherein the axis of rotation (31) about which the spring assembly (33) rotates with the actuating arm (32) is arranged in a fixed manner in the housing (21), so that the spring assembly (33) with the actuating arm (32) pivots about the axis of rotation (31).

11. The piece of furniture according to claim 1, wherein a lever (37) of the multi-joint connection has two axes of rotation (A1, A3) for moving the movable furniture part and has a further joint (40) or a curve guide (41) for indirect coupling to the actuating arm (32).

12. The piece of furniture according to claim 11, wherein the actuating arm (32) is connected to the lever (37) of the multi-joint connection by a joint lever (36).

13. The piece of furniture according to claim 11, wherein a pressure-exerting component (45) is arranged on the actuating arm (32) and cooperates with the curve guide of the lever (37).

14. The piece of furniture according to claim 1, wherein the total pivot angle of the spring assembly (33) about the axis of rotation (31) from the closed position into the fully open position of the movable furniture part is greater than 10°.

15. The piece of furniture according to claim 1, wherein the pivot drive (30) is arranged in a side wall (10) of the piece of furniture (1).

16. The piece of furniture according to claim 15, wherein the side wall (10) has a plate-shaped core (11) which has a first end face and further end faces, and wherein a recess (12) is arranged in the core (11), which recess extends at least along a section of the first end face of the side wall and serves to receive a flap fitting (4) which guides the movable furniture part.

17. The piece of furniture according to claim 16, wherein the plate-shaped core (11) of the side wall (10) is arranged between two laterally applied cover layers (13).

18. The piece of furniture according to claim 17, wherein the core (11) has two core halves which lie one on top of the other with their side faces opposite the respective cover layers (13) and have recesses which complement one another to form the recess (12).

19. The piece of furniture according to claim 1, wherein the pivot drive (30) is arranged on a side wall (10) of the furniture (1).

* * * * *